US005693288A

United States Patent [19]

Nakamura

[11] Patent Number: 5,693,288

[45] Date of Patent: Dec. 2, 1997

[54] SEAL ASSEMBLY FOR THERMAL TREATMENT FURNACES USING AN ATMOSPHERIC GAS CONTAINING HYDROGEN GAS

[75] Inventor: Teruhisa Nakamura, Shin Nanyo, Japan

[73] Assignee: Nisshin Steel Co., Ltd., Toyko, Japan

[21] Appl. No.: 596,170

[22] PCT Filed: Jun. 23, 1995

[86] PCT No.: PCT/JP95/01256

§ 371 Date: Feb. 13, 1996

§ 102(e) Date: Feb. 13, 1996

[87] PCT Pub. No.: WO96/00307

PCT Pub. Date: Jan. 4, 1996

[30] Foreign Application Priority Data

| | | | |
|---|---|---|---|
| Jun. 24, 1994 | [JP] | Japan | 6/164903 |
| Jun. 29, 1994 | [JP] | Japan | 6/168639 |
| Sep. 30, 1994 | [JP] | Japan | 6/259779 |
| Oct. 26, 1994 | [JP] | Japan | 6/284560 |

[51] Int. Cl.[6] ..... C21D 9/54

[52] U.S. Cl. ..... 266/103; 432/242

[58] Field of Search ..... 266/102, 103; 432/242, 244

[56] References Cited

U.S. PATENT DOCUMENTS

| | | | |
|---|---|---|---|
| 2,367,174 | 1/1945 | Renkin | 432/242 |
| 3,291,468 | 12/1966 | Albertsen et al. | 266/103 |
| 3,306,594 | 2/1967 | Bauer | 432/242 |

*Primary Examiner*—Scott Kastler

*Attorney, Agent, or Firm*—Kanesaka & Takeuchi

[57] ABSTRACT

A seal assembly (3) located at an entrance and/or exit of a heat treatment furnace for heat treating a metallic strip (S) with no formation of oxide films on the surface thereof, using an atmospheric gas containing hydrogen gas and including an elastic rotating roll (6) being pressedly engaged with an elastic pad (5) fixed on the surface of a seal plate (4) and the metallic strip (S) to seal the inside of the furnace against the outside air, wherein elastic members (9) being provided in through-holes (**2*b*) formed through a side plate (2*a*) of a furnace wall (2) at positions corresponding to both side edges of the elastic pad (5), and elastic member-moving mechanisms (10) being provided for pressedly engaging the elastic members (9) with the sides of the elastic pad (5); at least two closely-set slip disks (7) arranged in an axial direction of the side of a roll body (6*c*) and an elastic disk (8) being fitted over a roll shaft (6*a*) between the side plate (2*a*) of the furnace wall (2), on which the elastic rotating roll (6) is rotatably mounted, and a roll body (6*c*) of the elastic rotating roll 6, the slip disk and said elastic disks being in surface contact with each other; of the contact surfaces of the parts present from the roll body (6*c*) to the side plate (2*a*) of the furnace wall (2), the contact surface of the slip disks (7) and (7**) having the lowest coefficient of dynamic friction.

13 Claims, 17 Drawing Sheets

SEAL ASSEMBLY FOR THERMAL TREATMENT FURNACES USING AN ATMOSPHERIC GAS CONTAINING HYDROGEN GAS

TECHNICAL FIELD

The present invention relates to a seal assembly having an improved sealability, which is used at an entrance and/or exit of a heat treatment furnace for annealing, stress relieving annealing or otherwise heat treating a metallic strip such as a stainless steel or high alloy strip with no formation of oxide films on the surface thereof, using a reducing, combustible atmospheric gas containing hydrogen gas as a furnace gas, thereby isolating the inside of the furnace from the outside air.

BACKGROUND TECHNIQUE

In a heat treatment furnace for annealing, stress relieving annealing or otherwise heat treating a metallic strip such as a stainless steel or high alloy strip while no oxide film is formed on the surface thereof, a combustible, reducing atmospheric gas such as a mixed gas consisting of 75% of hydrogen gas and 25% of nitrogen gas (hereinafter called simply the furnace gas) is fed into the furnace.

An assembly for isolating the inside of the furnace from the outside air is usually mounted on portions of the entrance and/or exit thereof through which the metallic strip is to be passed, thereby preventing mixing of the outside air with the furnace gas (hereinafter called sealing). A typical example of such a seal assembly is disclosed in Japanese Patent Publication No. 42(1967)-18893. As disclosed, this seal assembly is built up of elastic rotating rolls for holding therebetween a metallic strip continuously fed into the furnace, said rolls rotating at a speed substantially equal to the feed speed of the metallic strip, a flexible seal plate fixed at ends to the furnace body, and felt or other elastic pads for making seals between the seal plate and the elastic rotating rolls.

One example of a conventional heat treatment furnace for heat treating a metallic strip continuously fed thereinto using an atmospheric gas containing hydrogen gas as a furnace gas will now be explained generally with reference to a shaft type of a bright annealing furnace for annealing a stainless steel strip or other high alloy strip.

FIG. 15 is a schematic view of the general structure of a shaft type of bright annealing furance for a stainless steel strip, etc. A metallic strip S is guided by a bottom roll into the furnace through a seal assembly 13 located on the entrance side of of a furnace body 1, where it is heated to a predetermined temperature, then cooled and finally annealed as desired. The thus treated strip is then fed out of the furnace through a seal assembly 13 located on the exit side. Usually, a reducing, combustible furnace gas 12 containing hydrogen gas is continuously fed into the furnace while it is cooled and circulated through, so that the inside pressure of the furnace can be kept an about 10 to about 50 $mmH_2O$ higher than the outside air. It is here to be noted that while the furnace is in operation, the furnace gas 12 leaks little by little through the seal assemblies 13 and 13 located at the entrance and exit of the furnace body 1, thereby preventing penetration of air (oxygen) into the furnace body 1 and so avoiding mixing of air with the furnace gas 12.

FIGS. 16 and 17 are enlarged front and side views of a conventional seal assembly located on the exit side of the furnace respectively. The conventional seal assembly, shown at 13, is of the structure wherein elastic pads 15 formed of felt or a felt equivalent are fixed on the surfaces of seal plates 14 secured on a furnace wall 2 by a bolt-and-nut combination, and elastic rotating rolls 16 with the surfaces made of elastic rubber are engaged with the metallic strip S and elastic pads 15 by the working force of a piston rod 11*a* driven by a cylinder, so that the inside of the furnace 1 can be isolated from the outside air.

Based on FIGS. 16 and 17, a brief account will here be given of a roll-driving mechanism 11 for pressedly engaging the elastic rotating rolls 16 with the elastic pads 15 fixed on the surfaces of the seal plates 14 secured on the furnace wall 2 and the metallic strip S. A lever 11*b* is pivotally fixed on a fixed pin 11*c* that defines the center of rotation thereof. The lever 11*b* is provided at its front end with a bearing 16*b* for supporting a roll shaft 16*a* of the elastic rotating roll 16, with the rear end receiving the working force of the piston rod 11*a* driven by the cylinder. The working force of this piston rod 11*a* allows the two elastic rotating rolls 16 and 16 to be pressedly engaged with the metallic strip S that is passed between the elastic rotating rolls 16 and 16 and, at the same time to be pressedly engaged with the elastic pads 15 and 15 fixed on the seal plates 14 and 14, respectively. Thus, the inside of the furnace body 1 is isolated from the outside air, so that the furnace body 1 can be sealed up against entrance of the outside (atmospheric) air into the furnace body 1.

Insofar as the arrangement of FIG. 16 is concerned, such a seal assembly 13 built up of the elastic rotating rolls 16 for holding therebetween the continuously fed metallic strip S and the elastic pads 15 fixed on the surfaces of the seal plates 14 secured on the furnace wall 2 appears to offer no problem. As can be seen from the side view of FIG. 17, however, it is uncertain whether sufficient seal is constantly achieved on both sides of the seal assembly 13, i.e., in the vicinity of both ends of the elastic rotating roll 16 and in the vicinity of the elastic pads 15 including the seal plates 14. Thus, some difficulty is left as to the sealing properties of this seal assembly on both side portions.

Another problem with the conventional seal assembly 13 is that it is unacceptable that the seal plate 14 becomes longer, if so caused, than the length of the gap between both side plates 2*a* and 2*a* of the furnace wall 2, because the ability of the seal assembly 13 to seal the elastic rotating roll 16 and furnace wall 2 against gas leakage decreases due to the irregular waving or deformation of the seal plate 14. This may be avoided by shortening the length of the seal plate 14, for instance, by a few millimeters, of the length of the gap between both side plates 2*a* and 2*a*, as shown in FIGS. 17, 18(*a*), 18(*b*), 18(*c*), 19 and 20. Then, an elastic pad 15 of felt etc. that is slightly, for instance, a few millimeters, longer than such gap length is fixed onto the surface of the short seal plate 14, using an adhesive material or a bolt-and-nut combination. Both side edges of the elastic pad 15 are so constructed that they project from the both side edges of the seal plate 14 to the both side plates 2*a* and 2*a*. Thus the both side edges of the elastic pad 15 are pressedly engaged on the sides 2*a*, 2*a* of the furnace wall, the both side edges of the elastic pad 15 are slightly bent, and the sealing properties of the seal assembly 13 can be so maintained that the furnace body can be well sealed against leakage of the furnace gas 12 and penetration of the outside air into the furnace body.

When a felt pad is used as this elastic pad 15, many problems arise. Since the felt pad is generally fabricated by felting of fibers and is in no sense metal or plastics, no sufficient dimensional accuracy can be imparted thereto by casting or machining. Nor is it rigid. The felt pad cannot precisely be cut by a cutting knife and, if somehow cut, it is likely to be strained or distorted. Moreover, the felt pad is likely to have defects by reason of drying, moisture absorption, bending, breaking, etc., during storage. Upon elongation for removal of such defects, it is readily increased in the full length or otherwise deformed. Thus, the felt pad is generally poor in dimensional accuracy. Upon fixed onto the seal plate 14 by use of an adhesive material, the felt pad absorbs moisture and so is readily increased in the full length or otherwise deformed. Upon fixing onto the seal plate by use of a bolt-and-nut combination, the felt pad is locally compressed and so is readily strained or distorted. It is thus difficult and troublesome to fabricate a felt pad of proper length as desired with the length of the gap between the side plates 2*a* of the furnace wall 2 in mind. To add to this, the attachment of a felt pad fixed onto the seal plate 14 to the furnace wall 2 as by a bolt-and-nut combination is not only time-consuming but also needs some skill, because the bolt and nut need be clamped in place while the distance between the felt pad end and the side plate 2*a* is regulated. These are also true with the elastic pad 15 is formed of rubber, etc.

The above problems will now be explained more specifically. When the length of the elastic pad 15 in the form of a felt pad is longer than that of the space between the side plates 2*a* and 2*a* of the furnace wall 2, as illustrated in FIG. 18(*a*), its side ends are bent along, and engaged with, the inner faces of the side plates 2*a* and 2*a*. In this example, between the sites of engagement of the side plates 2*a* of the furnace wall 2 with the elastic rotating roll 6 and the felt pad there are formed gaps through which the furnace gas 12 leaks. Even when the felt pad is fixed onto the seal plate 14 while it is shifted toward one side plate 2*a*, such gas leakage occurs. When the length of the elastic pad 15 in the form of a felt pad is shorter than that of the space between the side plates 2*a* and 2*a* of the furnace wall 2, as illustrated in FIG. 18(*b*), its side edges are in no engagement with the side plates 2*a*. In this example, between the side plates 2*a* and the felt pad there are formed gaps through which the furnace gas 12 leaks. Even when the felt pad is fixed onto the seal plate 14 while it is shifted toward one side plate 2*a* or when the length of the elastic pad 15 in the form of a felt pad is longer than the length of the space between the side plates 2*a* and 2*a* of the furnace wall 2, as illustrated in FIG. 18(*c*), its side end is tightly engaged with the inner faces of the side plates 2*a*. In this example, the felt pad is curved to depart from on the surface of the elastic rotating roll 16 to form a gap between the felt pad and the surface of the elastic rotating roll 16, through which gap the furnace gas 12 leaks.

In any case, it is difficult to allow the elastic pad 15 in the form of a felt pad to have a width well accommodating to the space between the side plates 2*a* and 2*a* of the furnace wall 2. The dimensional accuracy of the seal plate 14, especially the felt pad, the alignment of both parts, and the incorporation of both parts to an entrance and exit need experience, perception, and skill, depending on which the sealing properties of the seal assembly vary. In some cases, it is required to redo the incorporation of the parts at an entrance and exit.

The sealing properties of the seal assembly drop when, between the side plates 2*a* of the furnace wall 2 and the side edge of the elastic pad 15 or between the ends of the elastic pad 15 and the ends of the elastic rotating roll 16, there are formed gaps due to the frictional contact and hence deformation of the elastic pad 15 with the elastic rotating roll 16 which continues to rotate while the furnace is in operation, or because of the drying or heating of the elastic pad caused by a slight amount of the furnace gas 12 jetted out. Even in this case, the elastic pad 15 itself must be replaced with another only for the reason that the sealing properties between the end of the elastic pad 15 and that of the elastic rotating roll 16 dropped. For the replacement of this elastic pad 15, furnace gas 12 containing the hydrogen gas must be replaced by a nitrogen gas atmosphere that is free from any risk of firing or explosion to secure safety. To this end, after replacement of elastic pad 15, not only the furnace body 1 is cooled with the injection of nitrogen gas thereinto, but the furnace gas 12 must also be fed again in the furnace body and heated in accordance with the predetermined procedures for resuming operation. In the meantime, the furnace must be shut down over an extended period of time, for instance, over a few days to one week although depending on the type, structure, and capacity of the furnace used. Thus, much economical losses such as efficiency and productivity drops, the wasting-away of cost, and a failure in production schedules are incurred.

For the elastic rotating roll 16 used with the conventional seal assembly 13, it has been proposed to attach a roll body 16*c* to the side plate 2*a* of the furnace wall 2 through three washers 16*d*, 16*e* and 16*f* as shown in FIG. 21(*a*) or through two washers 16*d* and 16*f* as shown in FIG. 22(*a*) (see Japanese Patent Publication No. 42-18893). As illustrated in FIGS. 21(*a*) and 22(*a*), the roll body 16*c* is tightly provided at one end with the rubber washer 16*d*, friction washer 16*e*, and metallic sealing washer 16*f*, or alternatively the rubber washer 16*d* and metallic sealing washer 16*f*, in order from the side of the roll body 16*c*. A closed-cell form of spongy neoprene is used for the rubber washer 16*d*, fluorocarbon resin having a low wear rate (e.g., polytetrafluoroethylene resin) for the friction washer 16*e*, and carbon steel, stainless steel or non-ferrous metal for the metallic sealing washer 16*f*.

However, the seal assembly 13 with the above elastic rotating roll 16 built in it has the following problems.

Referring to FIGS. 21(*a*) and 21(*b*), the metallic sealing washer 16*f* comes in sliding contact with the side plate 2*a* of the furnace wall 2 on a plane shown by A as shown in FIG. 21(*b*). The coefficient of friction varies largely between when greased and when not greased. The rotational force of the elastic rotating roll 16 is transmitted to the side plate 2*a* of the furnace wall 2 by the elasticity of the rubbery washer 16*d*. When fully greased, the sliding surface is defined by the plane A, but when insufficiently greased, the sliding surface is defined by a plane B on which the metallic sealing washer 16*f* comes in contact with the friction washer 16*e*. When the plane B becomes the sliding surface, the metallic sealing washer 16*f*, which remains fixed, comes in contact with the rotating roll shaft 16*a*, and this causes them to be mutually damaged and worn away, as shown in FIG. 21(*c*). As a result, the sealing properties of the metallic sealing washer 16*f* become worse, because the gap between the elastic rotation roll 16 and the metallic sealing washer 16*f* is widened or the gap between the elastic pad 15 and the metallic sealing washer 16*f* is widened.

Referring to FIGS. 22(*a*) and 22(*b*) of the conventional seal assembly, there is a large variation of the coefficient of friction as shown in FIG. 22(*b*) between when greased and when not greased, because the metal parts come in sliding contact with each other on a plane A, as in the case of FIG. 21(*a*). When fully greased, the sliding surface is defined by the plane A. When not sufficiently greased, however, the sliding surface is defined by any of planes A, B and C, because they have a close coefficient of friction. Usually, however, greasing cannot be applied to the entrance and exit of a heat treatment furnace such as a bright annealing furnace. So far, the metallic strip S has been pre-treated in a degreasing (cleansing) apparatus, because it is colored or stained by deposition of oil matter. Even though greasing should be restricted to the ends of the roll, the grease would be gradually transmitted to the middle of the roll, resulting in coloration or contamination and, hence, degradation, of the surface of the metallic strip S. Now consider the case where greasing is done but it is done insufficiently. When the sliding surface is defined by the plane A, the metallic sealing washer 16*f* is brought into rotating, sliding contact with the frame 2, whereby they are mutually damaged. When the sliding contact surface is defined by the plane B, the rubber washer 16*d* is drastically worn away. Besides, since rotational torque is transmitted to the washer 16*d* from the end surface sides of the roll while the metallic sealing washer 16*f* remains substantially fixed due to friction with the side plate 2*a* of the furnace wall 2, the rubber washer 16*d* remains braked on the plane B. Consequently, the rubber washer 16*d* is torsionally distorted and so out of normal disk shape, whereby it is spaced away from the plane B or C, making the sealing properties worse. When the sliding surface is defined by the plane C on which the rubber washer 16*d* comes in contact with the roll body 16*c*, the rubber washer 16*d* is rapidly worn away due to sliding contact with the lining material of the elastic rotating roll 16 and with the metallic portion of the end of the roll. Besides, the rubber washer 16*d* is torsionally distorted and so out of normal disk shape, as is the case where the sliding surface is defined by the plane B. On the plane B or C, the metallic sealing washer 16*f* remains substantially fixed due to friction with the side plate 2*a* of the furnace wall 2 to define the fixed side. The metallic sealing washer 16*f* comes in contact with the rotating roll shaft 16*a* and with the side plate 2*a* of the furnace wall 2 as well because the torque transmitted from the roll is larger than that in the case of FIG. 21(*a*), whereby they are mutually damaged and so worn away. Consequently, the sealing properties of the seal assembly become worse, as can be seen from FIG. 22(*c*).

In the seal assembly shown in FIG. 21(*a*), the rotating portion is usually separated by the contact surface B from the fixed portion, and the metallic sealing washer 16*f* and the rotating roll shaft 16*a* are brought into contact with each other and so mutually worn away. In the seal assembly shown in FIG. 22(*a*), sliding movement occurs on any one of the contact planes A, B and C. On the plane A the side plate 2*a* of the furnace wall 2 and the metallic sealing washer 16*f* are worn away, and on the plane B or C, the rubber washer 16*d* per se is worn away while the metallic sealing washer 16*f* and roll shaft 16*a* are brought into contact with each other and so mutually worn away. In other words, when the contact surface causing slippage is defined by a member other than the friction washer 16*e*, the sealing properties of the seal assembly become worse, because it is worn away due to its poor wear resistance to form a gap. As a result, the amount of the furnace gas 12 leaking out of the furnace increases with an increase in the consumption of the atmospheric gas. On fire, the seal assembly is heavily damaged. Frequent replacement of worn away parts is thus required.

However, even when at least one of the worn-away washers 16*d* , 16*e* and 16*f* provided in order from the end surface of the roll body 16*c* of the elastic rotating roll 16 is replaced, it is required for safety's sake that the feeding of the metallic strip S be interrupted to cool the furnace body 1 from within the furnace body 1, and that the furnace gas 12 be expelled out by the injection of inactive gas such as nitrogen gas etc. This is very time-consuming and troublesome, and costs much as well. When the inner surface of the side plate 2*a* of the furnace wall 2 is burnt away, bitten off or otherwise worn away to such an extent that smooth rotation is inhibited, it is also required to replace the side plate 2*a* of the furnace wall 2 in its entirety or remove at least the elastic rotating roll 16 from the side plate 2*a* of the furnace wall 2 so that another reinforcement member can be attached to the inner surface of the side plate 2*a* of the furnace wall 2. For safety's sake, it is then required that the feeding of the metallic strip S is interrupted and the furnace gas 12 is removed from within the furnace body 1. This offers disadvantages preventing an easy operation thereof.

DISCLOSURE OF THE INVENTION

The present invention can resolve the above-mentioned conventional technical defects and provide a seal assembly having improved sealing properties, which is designed to be located at an entrance and exit of a heat treatment furnace using a reducing, combustible atmospheric gas containing hydrogen gas as a furnace gas, wherein between the end of an elastic rotating roll and a side plate of a furnace wall there is formed no gap at the ends of an elastic pad, and it further provides a seal assembly of greater safety and improved efficiency and productivity, which is used with a heat treatment furnace using a furnace gas containing hydrogen gas, wherein a drop of the sealing properties caused by a weary out generated by slippage between washers located at the ends of the roll body of the elastic rotating roll and mutual damages on the washers and the side plate of the furnace wall or a slippage therebetween is prevented, the sealing properties of the ends of the elastic rotating roll that rotates in synchronism with the moving metallic strip are in good condition, and the frequency of replacement of the elastic rotating roll and washers is decreased.

In order to solve the former in the above-mentioned problems, the present inventor has made research to find that the above objects can be achieved by the provision of a seal assembly located at an entrance and/or exit of a heat treatment furnace using an atmospheric gas containing hydrogen gas and including an elastic rotating roll which is engaged with an elastic pad fixed on the surface of a seal plate located integrally on the furnace wall of the furnace body and the metallic strip to seal the inside of the furnace against the outside air, wherein elastic members are provided in through-holes formed through a side plate of a furnace wall at positions corresponding to those of the both side edges of the elastic pad, and elastic member-moving mechanisms are provided pressedly for engaging the elastic members with the sides of the elastic pad, the seal plate and elastic pad being slightly smaller than the separation between the right and left side plates, while confirming the furnace pressure using a pressure meter or manometer built in the furnace during the operation of the furnace.

In order to resolve the latter problem of the present invention, the present inventor has made research to find that upon the elastic roll rotated in association with the movement of the metallic strip, a slippage occurs between a rubber washer and a metallic sealing washer provided at the end of the roll body of the elastic rotating roll or the metallic sealing washer and the side plate of the furnace wall, whereby such parts are worn away and so decreased in service life, by noticing improved resistance to wear, wherein such a slippage is restricted to between parts having a low coefficient of friction and improved wear resistance based upon the coefficients of friction listed in FIG. 14 to be further explained later. As a result, in the above seal assembly, at least two closely-set slip disks arranged in an axial direction of the side of a roll body and, at least one of the elastic disks which is engaged with the side plate of the furnace wall, are fitted over a roll shaft between the side plate of the furnace wall on which the elastic rotating roll is rotatably mounted and a roll body of the elastic rotating roll, the slip disk and said elastic disk being in surface contact with each other, and in the contact surfaces of the parts present from the roll body to the side plate of the furnace wall, the contact surface of the slip disks has the lowest coefficient of dynamic friction. Thus, a slippage occurs predominantly between the closely arranged slip disks while rotating portion and fixed portion are spaced away from each other on both sides of said slip disks, so that the transmission of the rotation of the elastic rotating roll in association with the movement of the metallic strip to the elastic disk provided on the side plate of the furnace wall can be prevented. This prevents the torsional distortion of the elastic disk and the wearing of the elastic disk, the side plate of the furnace wall, the roll shaft, and the end surfaces of the roll, resulting in prevention of a drop of the sealing properties and an increase in the service life of the elastic rotating roll and the side plate of the furnace wall.

BRIEF DESCRIPTION OF THE DRAWINGS

FIG. 23(*b*) is a graph showing coefficient of friction between the parts.

BEST MODE FOR CARRYING OUT THE INVENTION

Figure 1:
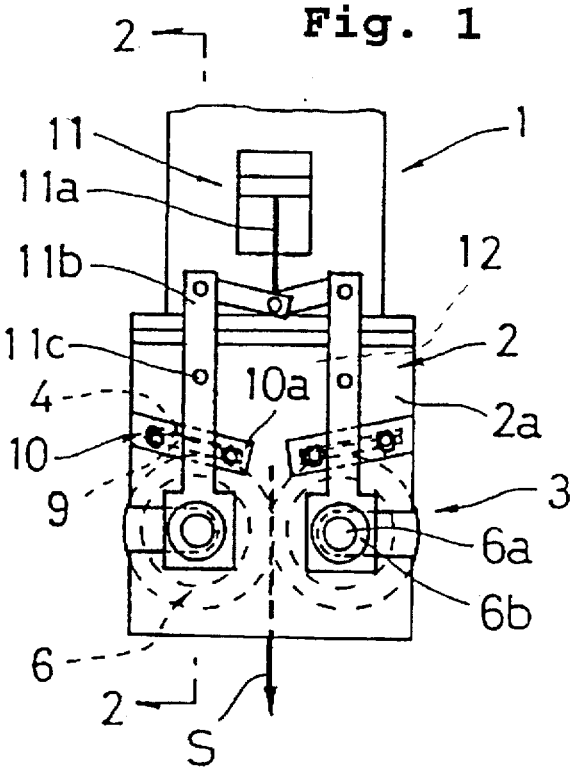
FIG. 1 is a front view of one embodiment of the present assembly located at an exit of a bright annealing furnace.

Referring to the accompanying drawings, reference numeral 1 generally represents a furnace body of a heat treatment furnace in which a reducing, combustible atmospheric gas containing hydrogen gas is used as a furnace gas 12 for continuously annealing, stress relieving annealing or otherwise heat treating a metallic strip S such as a stainless steel strip. In the furnace body 1, the prevailing pressure is kept about 10 to about 50 $mmH_2O$ higher than the outside air by feeding the furnace gas 12 thereto.

Reference numeral 2 stands for a furnace wall located at an entrance and exit of the furnace body 1 with the furnace gas 12 prevailing therein. As illustrated, the furnace wall 2 is positioned on both widthwise sides of the metallic strip S continuously fed through the furnace body 1 via the entrance and exit thereof, and includes a side plate 2*a* of the furnace wall 2 having at a given position a through-hole 2*b* through which an elastic member 9 is to be passed, as described later.

Reference numeral 3 denotes a seal assembly for a heat treatment furnace using an atmospheric gas containing hydrogen-gas as the furnace gas 12 according to the present invention, said seal assembly being located at the entrance and/or exit of the furnace body 1 with the furnace gas 12 prevailing therein. The seal assembly 3 is built up of a seal plate 4 fixed on the furnace wall 2, an elastic pad 5 fixed on the seal plate 40 and an elastic rotating roll 6 to be engaged with the elastic pad 5 and metallic strip S, thereby sealing up the furnace body 1 for preventing a leakage of the furnace gas 12.

The seal plate 4, for instance, is formed of a flexible, difficult-to-oxidize stainless steel thin sheet of about 0.5 to about 2.0 mm in thickness. The seal plate 4, wider than the width of the metallic strip S to be heat treated but narrower than the space between both side plates 2*a* and 2*a* of the furnace wall 2, is fixed on the furnace wall 2 by fixing means such as a bolt and nut combination.

The elastic pad 5 is slightly wider than, or equal to, the width of the seal plate 4, and is formed narrower than the space between both side plates 2*a* and 2*a* of the furnace wall 2. The pad 5 is then fixed on the surface of the seal plate 4 by an adhesive material or a bolt and nut combination while its end edge is located in a gap between the inner surfaces of both side plates 2*a* and 2*a* of the furnace wall 2. Here it is to be noted that the seal plate 4, especially the elastic pad 5 should essentially be located between the inner surfaces of both side plates 2*a* and 2*a* of the furnace wall 2 with a predetermined gap within the stroke range of the elastic member 9, described later, and within the allowable range of resiliency of the elastic member 9 as well.

The elastic rotating roll 6 must be of surface resiliency and is formed of elastic members such as silicone rubber (ASTM Code Q and composed of an alkylsiloxane copolymer), fluororubber (ASTM Code FKM and composed of a hydrocarbon fluoride copolymer), chloroprene rubber (ASTM Code CR and composed of a chloroprene polymer), nitrile-butadiene rubber (ASTM Code NBR and composed of a butadiene-acrylonitrile copolymer), styrene-butadiene rubber (ASTM Code SBR and composed of a butadiene-styrene copolymer), ethylene-propylene rubber (ASTM Code EPDM and composed of an ethylene-propylenediene copolymer), urethane rubber (ASTM Code U and composed of a polyesther (ether)-isocyanate polycondensate), hydrin rubber (ASTM Code CO and composed of an epchlorohydrin copolymer), butyl rubber (ASTM Code IIR and composed of an isobutyleneisoprene copolymer), isoprene rubber (ASTM Code and IR composed of synthetic isoprene rubber), butadiene rubber (ASTM Code BR and composed of a butadiene copolymer), chlorinated polyethylene (ASTM Code CM and composed of chlorinated polyethylene), acrylic rubber (ASTM Code ACM and composed of an acrylate ester copolymer), polysulfide rubber (ASTM Code T and composed of an alkylene sulfide polymer), and chlorosulfonated polyethylene (ASTM Code CSM and composed of chlorosulfonated polyethylene). Alternatively, the elastic rotating roll may be formed of a metallic roll member with the outer surface provided by an elastic member made of the above materials or simply made of felt, etc.

A plurality of closely arranged slip disks 7, each having a through-hole through which a roll shaft 6*a* of the elastic rotating roll 6 is to be passed, are located between a roll body 6*c* of the elastic rotating roll 6 and the side wall 2*a* of the furnace wall 2 and mounted around the roll shaft 6*a*. The slip disk 7 may be made of a plate material 7*a* (FIG. 13(*a*)) with the contact surface having a low coefficient of dynamic friction and being difficult to wear off, for instance, a plate form of fluorocarbon resin such as poly-tetrafluoroethylene resin, or a plate form of fluorocarbon resin such as polytetrafluoroethylene resin as the main component and to improve wear resistance, rigidity and electrical conductivity, a filler or fillers selected from the group of consisting of glass fiber, graphite, glass fiber plus molybdenum disulfide, glass fiber plus graphite, bronze, and carbon fiber. To obtain the slip disk 7*b*(FIG. 13(*b*)), a fluorocarbon resin only or a fluorocarbon resin with the filler is coated, sprayed, baked or the resin in a form of a sheet being pasted to the entire surface, including the inner, outer and both side surfaces of a metallic plate 7*x*. To obtain the slip disk 7*c*, (FIG. 13(*c*)) a fluorocarbon resin only or a fluorocarbon resin with the filler is coated, sprayed, baked or the resin in a form of a sheet being pasted on both sides of the metallic plate 7*x*. To obtain the slip disk 7*d*, (FIG. 13(*e*)) a fluorocarbon resin only or a fluorocarbon resin with the filler is coated, sprayed, baked or the resin in a form of a sheet being pasted to one side only of the metallic plate 7*x* proximate to the roll body 6*c*. To obtain the slip disk 7*e*, (FIG. 13(*d*)) a fluorocarbon resin only is coated, sprayed baked or the resin in a form of a sheet being pasted to one side only of the metallic plate 7*x* proximate to the wall 2*a* of the furnace wall 2 (reverse to the side of roll body 6*e*). As to obtaining slip disk 7*f*, (FIG. 13(*f*)) a metallic plate having the metallic surface is formed. The outer diameter of this slip disk 7 has one-half the maximum thickness of the metallic strip S or more and is slightly smaller than that of the roll body 6*c* of the elastic rotating roll 6, provided that sealability can be well maintained. When the elastic rotating roll 6 is engaged with the elastic pad 5 and the metallic strip S, its outer diameter becomes smaller due to the deformation of its outer periphery but the slip disk 7 suffers from no deformation owing to its rigidity and so is substantially invariable in outer diameter. This is the reason for the slip disk 7 being made slightly smaller in outer diameter than the elastic rotating roll 6, whereby there is maintained sealability between the roll bodies 6*c* even while they are contacting each other.

Figure 7A:
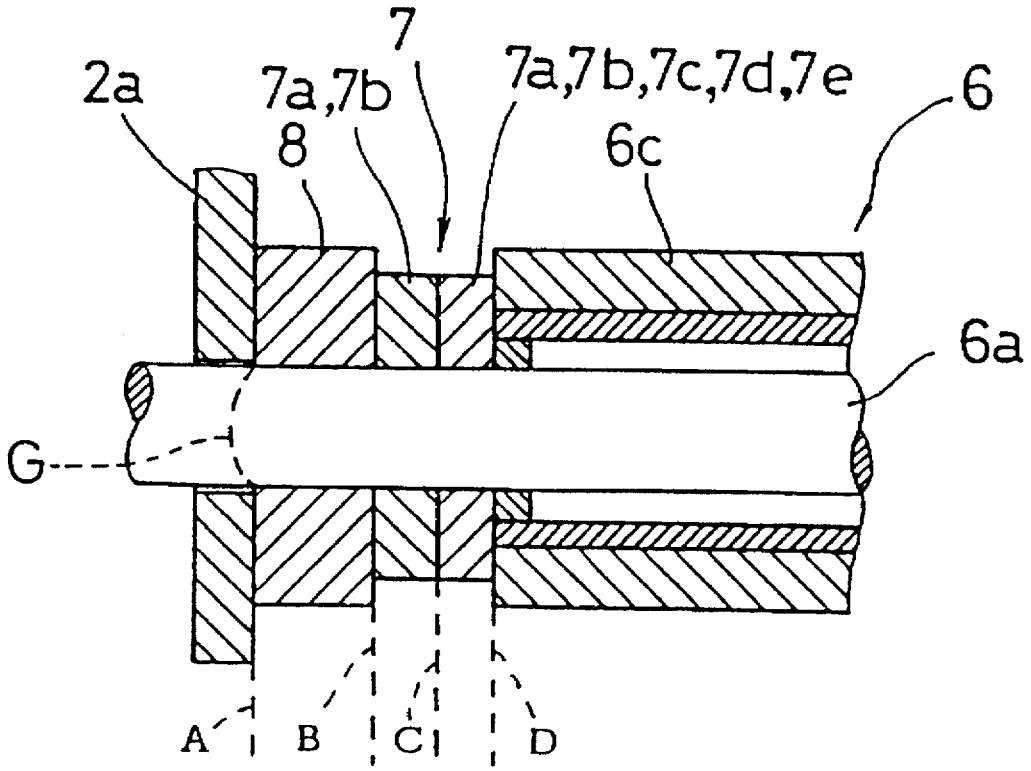
FIGS. 7(*a*), 8(*a*), 9(*a*), 10(*a*), 11(*a*), 12(*a*), 13(*a*), 13(*b*), 13(*c*), 13(*d*), 13(*e*) and 13(*f*) are sectional views of important parts, and FIGS. 7(*b*), 8(*b*), 9(*b*), 10(*b*), 11(*b*) and 12(*b*) are graphs showing the coefficient of friction between the parts.
Figure 7B:
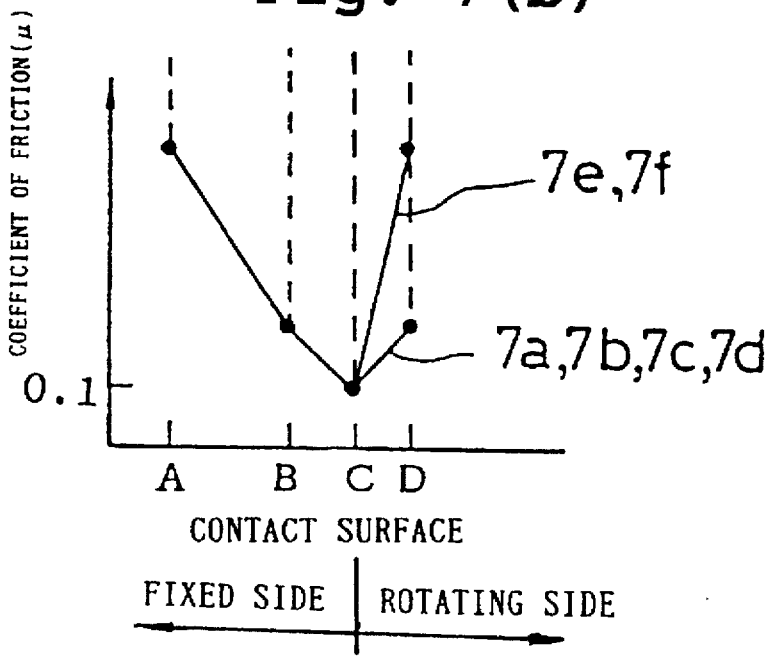
Figure 9A:
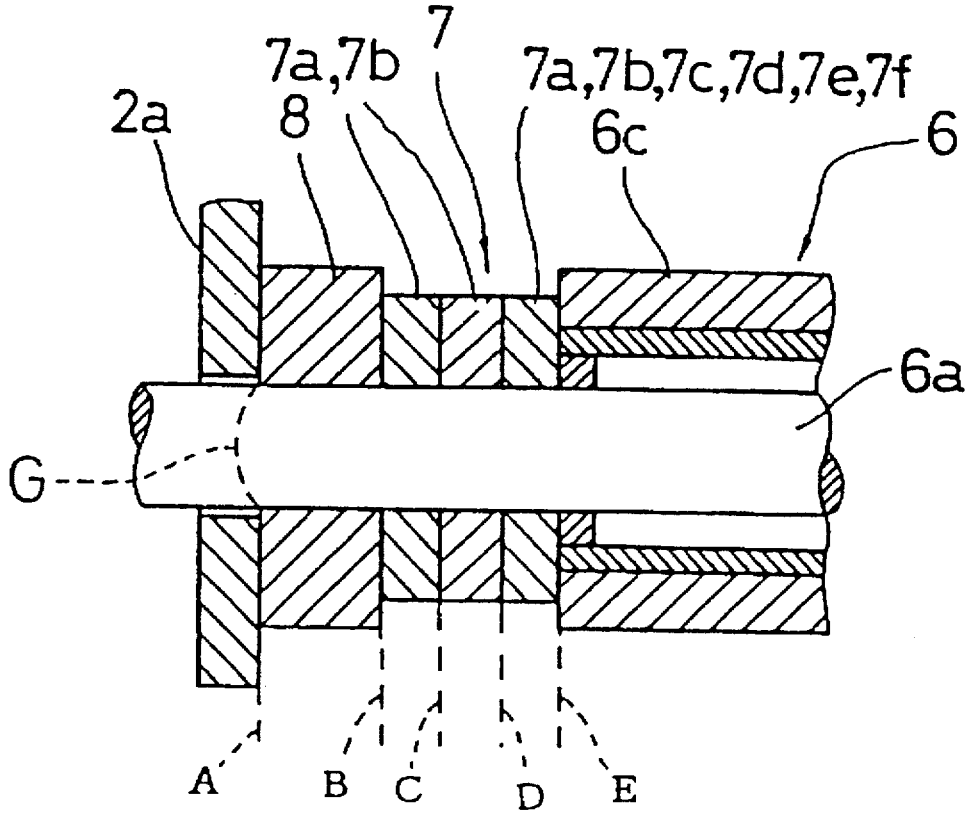
Figure 9B:
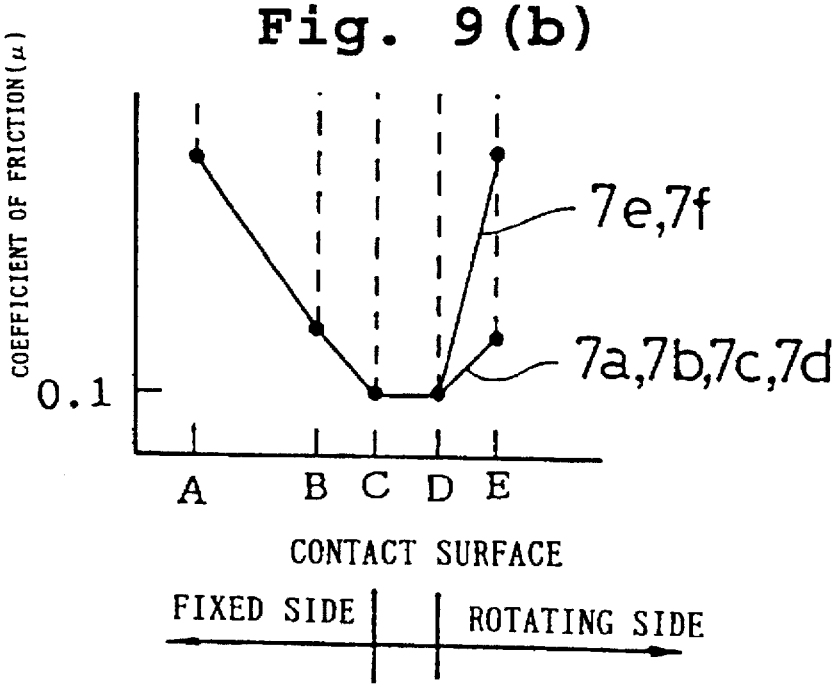

An elastic disk 8 is located on the side of the slip disk that faces the side wall 2*a* of the furnace wall 2 while it is in contact with the slip disk 7. The elastic disk 8 is fitted over the roll shaft 6*a* of the elastic rotating roll 6, which is passed through a through-hole centrally formed therein. The surface of contact of the elastic disk 8 with the slip disk 7 [as shown by plane B in FIGS. 7(*a*) to 12(*a*)] has a coefficient of dynamic friction larger than that of the contact surfaces of the slip disks 7 [shown by plane C in FIGS. 7(*a*), 8(*a*) and 10(*a*), 11(*a*) and 12(*a*) and shown by plane C and plane D in FIG. 9 (*a*)]. This elastic disk 8 may be formed of a rubber material such as silicone rubber, fluororubber, chloroprene rubber, nitrile-butadiene rubber, styrene-butadiene rubber, ethylene-propylene rubber, urethane rubber, hydrin rubber, butyl rubber, isoprene rubber, butadiene rubber, chlorinated polyethylene, acrylic rubber, polysulfide rubber, and chlorosulfonated polyethylene. Preferably, the rubber material used has a rubber hardness of A40° to 60° as measured according to JIS K6301 (or corresponding to a rubber hardness of about 65 to about 80 as measured according to JIS S6050 or 40° to 60° by ASTM D2240-A). Alternatively, use may be made of an elastic member which has an expanding mechanism in the axial direction of the roll shaft with a fluid poured therein. For example, an elastic member such as silicone rubber, fluororubber, chloroprene rubber, nitrile-butadiene rubber, styrene-butadiene rubber, ethylene-propylene rubber, urethane rubber, hydrin rubber, butyl rubber, isoprene rubber, butadiene rubber, chlorinated polyethylene, acrylic rubber, polysulfide rubber, and chlorosulfonated polyethylene, etc. may be centrally provided in an expanding mechanism with an inlet port through which a fluid such as air or oil is to be fed into the elastic member [it is here to be noted that an elastic disk shown at 8*a* in FIG. 10(*a*) should be restrained from rotation at the side of side plate 2*a* of the furnace wall 2 because the inlet port is connected with a fluid conductor]. Two or more such elastic disks 8 may be fitted over the roll shaft 6*a*, if they have no expanding mechanism. Anyhow, the elastic disk should have a rubber hardness large enough to enable the contact surface thereof to be in close contact with the roll with proper elasticity and, at the same time, the roll to rotate smoothly.

Figure 23A:
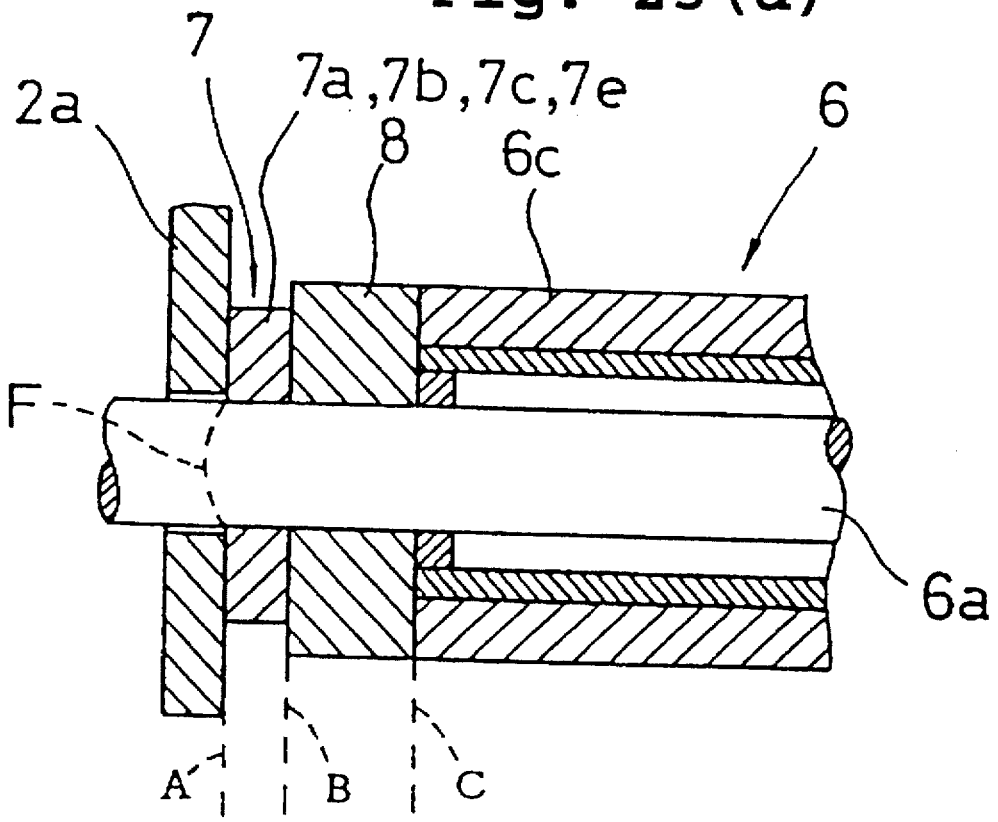
FIG. 23(*a*) is a sectional view of important parts of the invention.
Figure 23B:
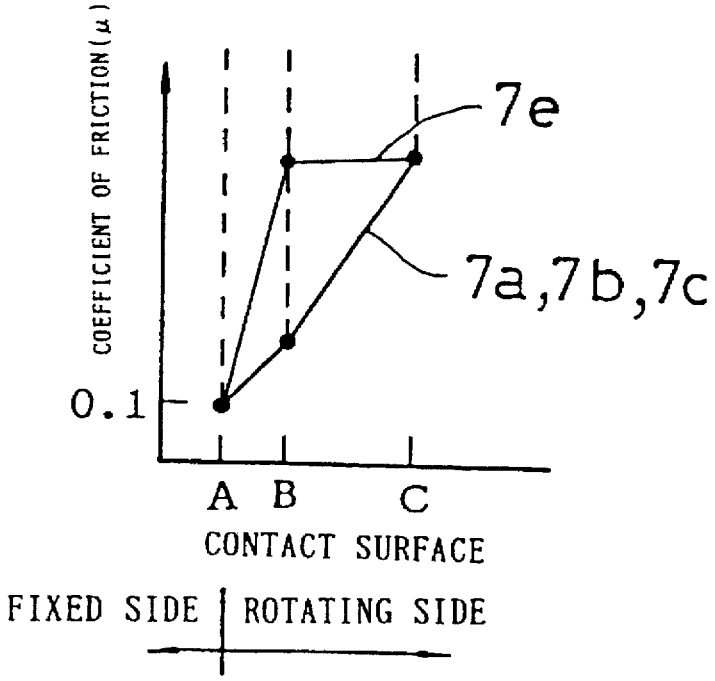

The disk located proximately to the side wall 2*a* of the furnace wall 2 while being in contact therewith, may be elastic disk 8 as mentioned above; or a structure as shown in FIG. 23(*a*); a slip disk 7*e*, 7*c*, 7*b*, 7*a* per se or which may be a sheet form of fluorocarbon resin such as polytetrafluoroethylene or a metallic sheet in which a fluorocarbon resin such as polytetrafluoroethylene as the main component added by a filler containing any one of glass fiber, graphite, glass fiber plus molybdenum disulfide, glass fiber plus graphite, bronze, and carbon fiber is coated, sprayed, baked, or a sheet being pasted on one or both sides thereof, or the entire surface thereof including the inner, outer and side surfaces; or an elastic disk 8 combined with the slip disks 7*e*, 7*c*, 7*b*, 7*a* in the end face of the roll. Since the slip disk 7 is bent outwardly of the furnace in the through-hole in the side wall 2*a* of the furnace wall 2 by the internal pressure generated from the elastic disk 8 as shown by a broken line F in FIG. 23(*a*), however, it is not preferable to use the surface of the side wall 2*a* of the furnace wall 2 as a sliding plane. In other words, it is preferable to use as the disk to be engaged with the side wall 2*a* of the furnace wall 2 the elastic disk 8 which need not entirely be rotated. The elastic disk 8 is slightly bulged out in the through-hole in the side wall 2*a* of the furnace wall 2 as shown by a broken line G in FIGS. (7*a*) 8(*a*) 9(*a*), 10(*a*), 11(*a*) and 12(*a*), but there is no problem because it is disconnected from the rotating portion by the slip disk 7.

Figure 8A:
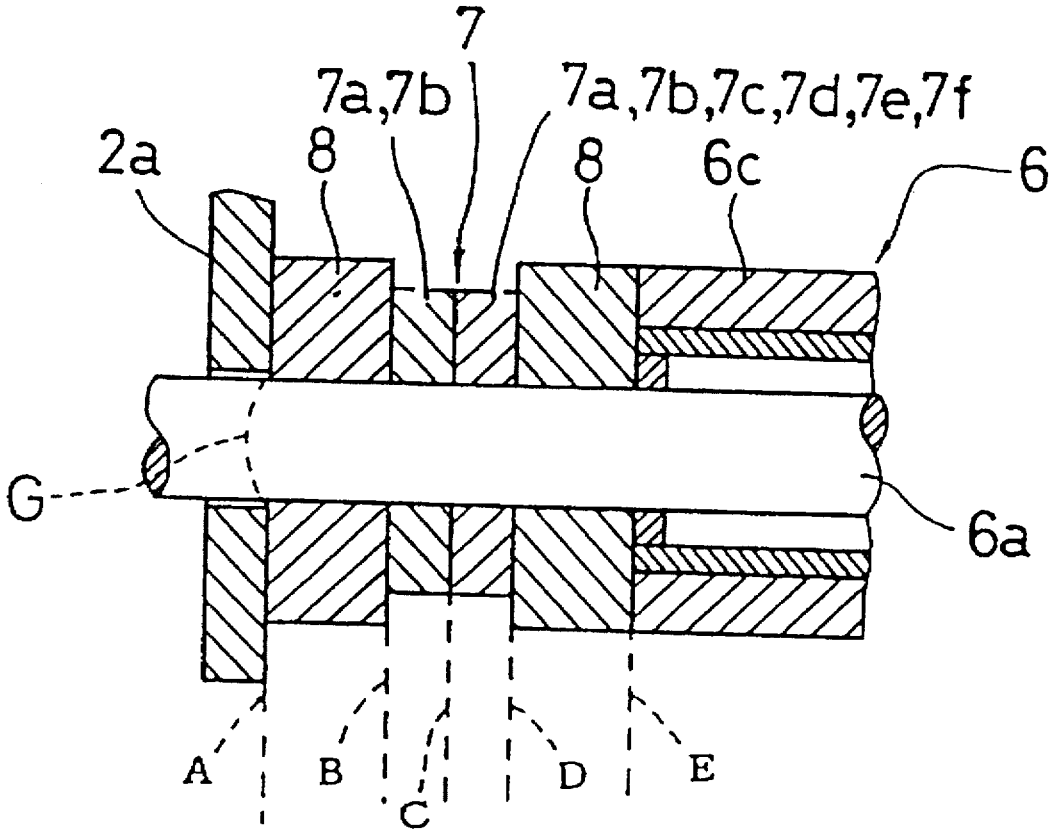
Figure 8B:
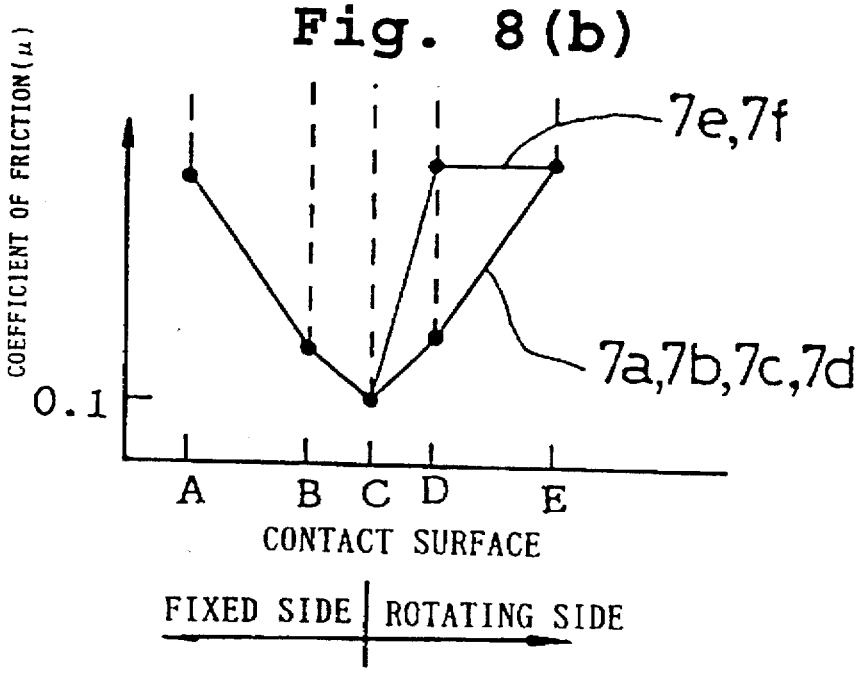
Figure 11A:
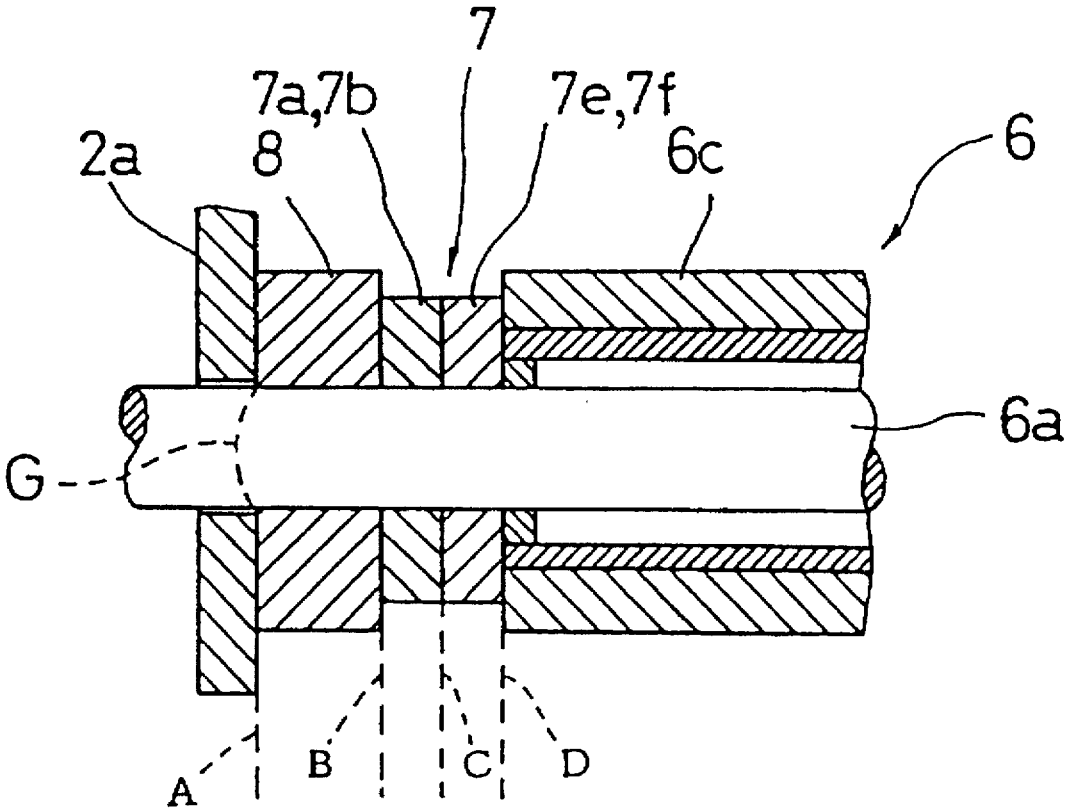
Figure 11B:
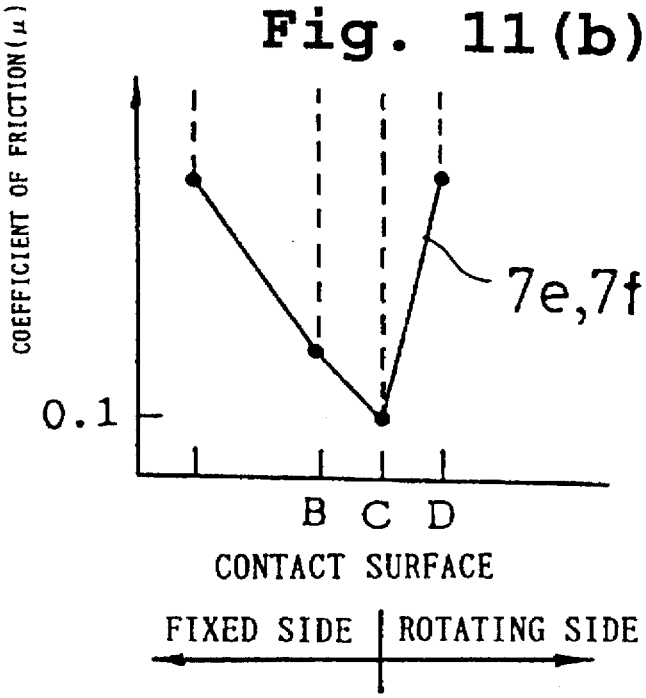
Figure 12A:
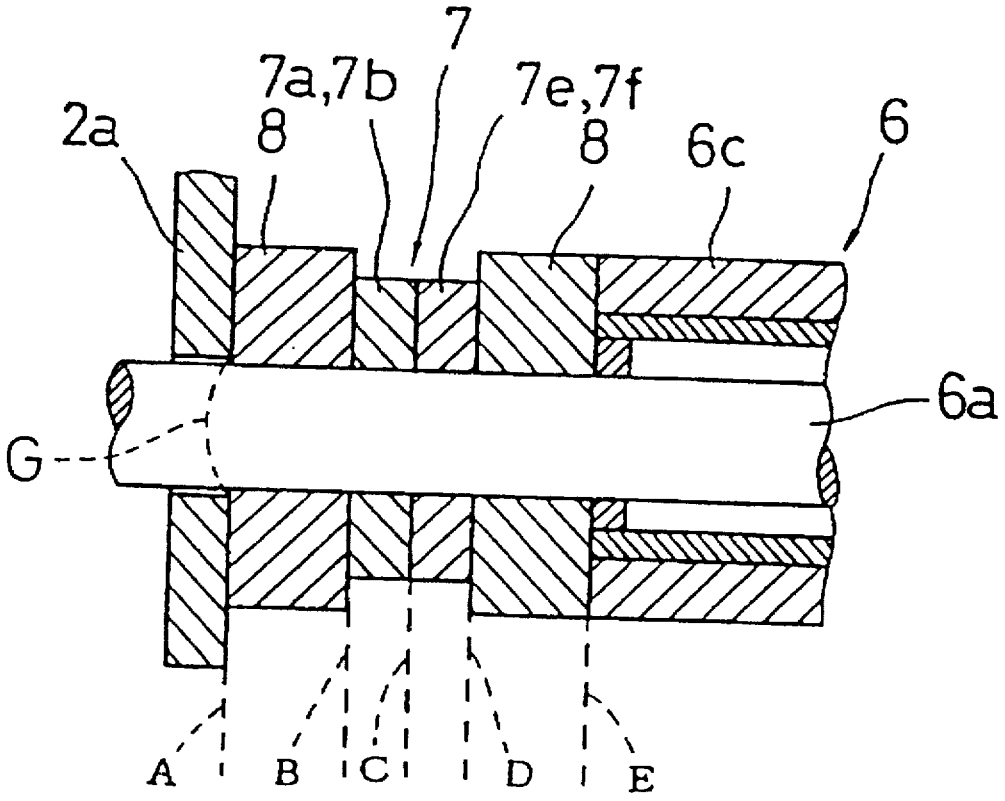
Figure 12B:
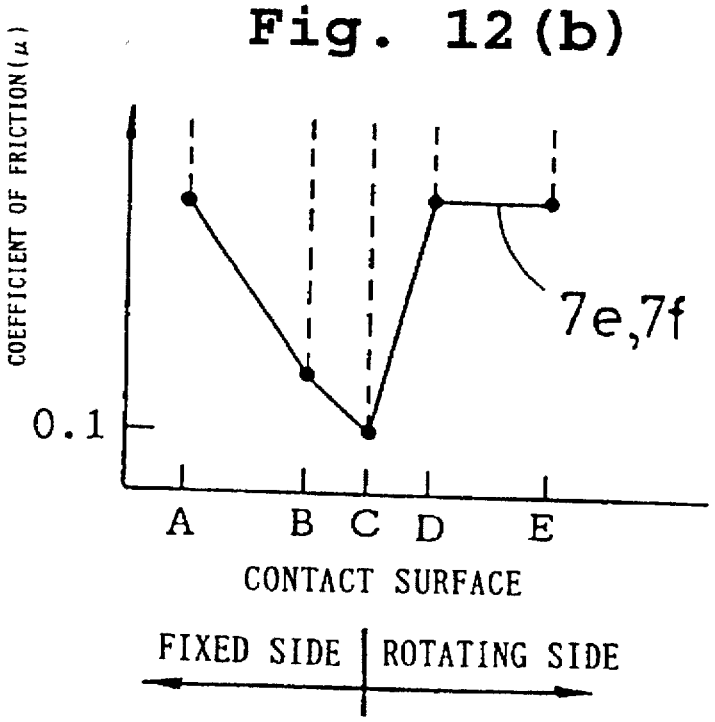
Figure 13A:
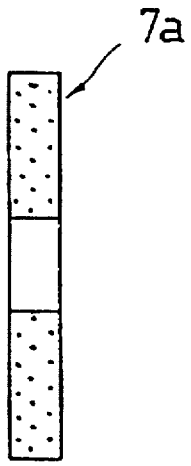
Figure 13B:
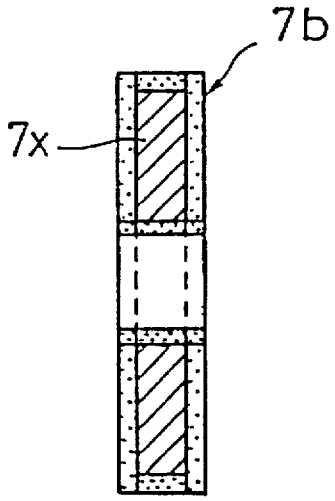
Figure 13C:
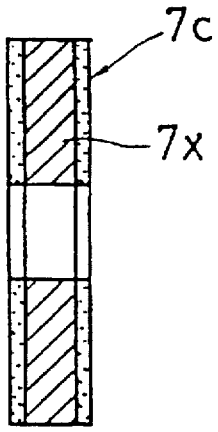
Figure 13D:
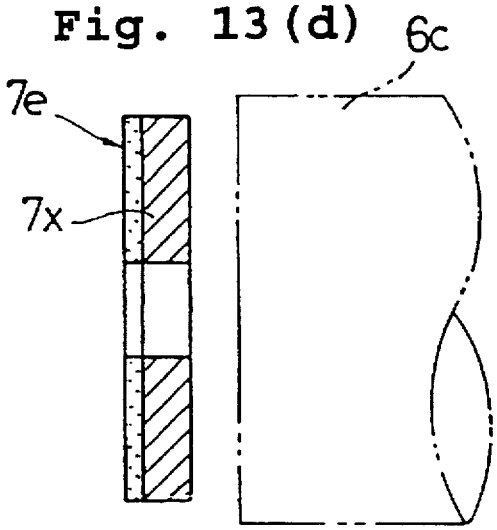
Figure 13E:
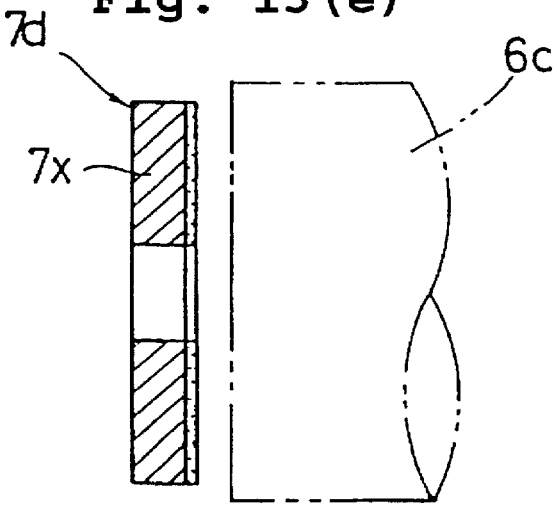
Figure 13F:
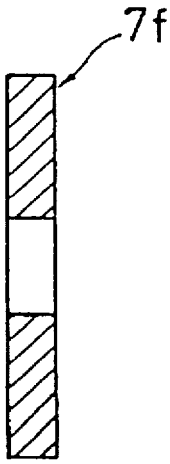
Figure 14:
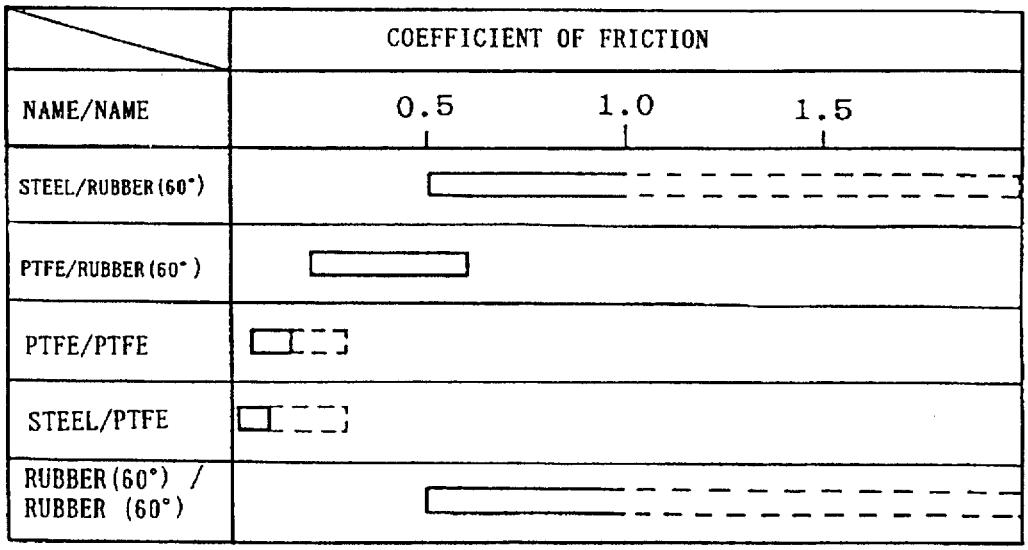
FIG. 14 is a graph showing coefficient of friction between parts.
Figure 15:
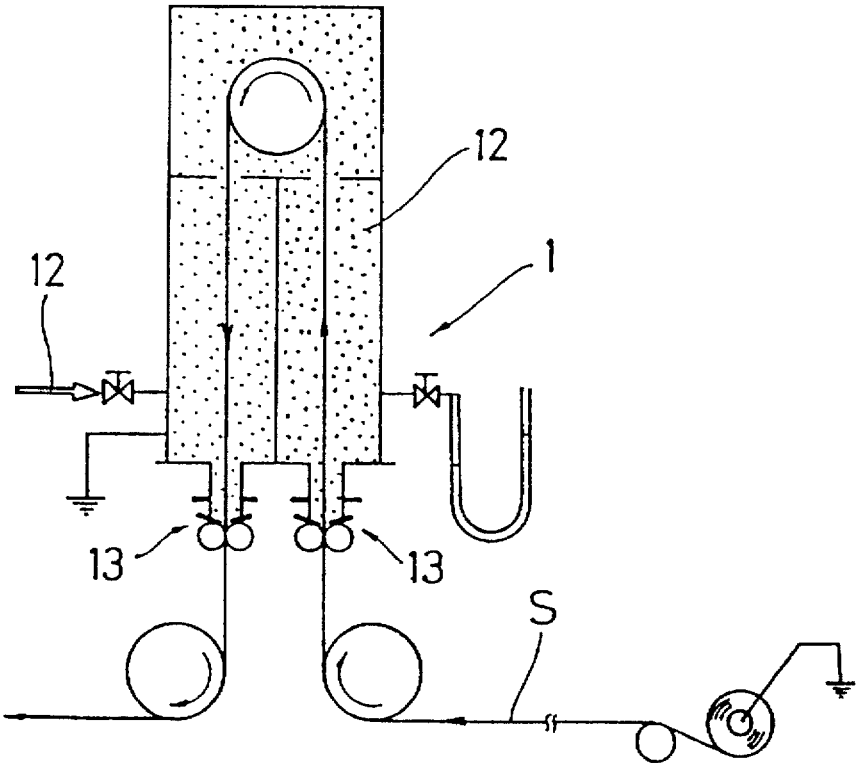
Fig. 15 Prior Art
FIG. 15 is a schematic view of a conventional shaft type bright annealing furnace.
Figure 16:
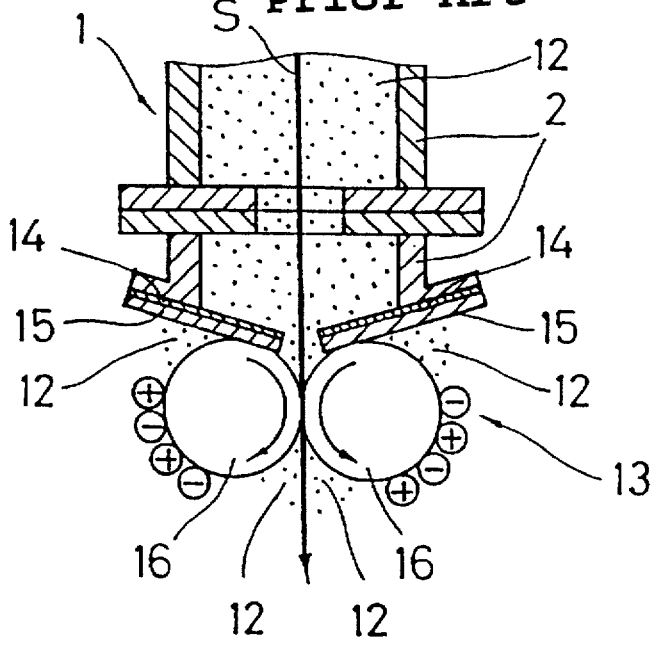
Fig. 16 Prior Art
FIGS. 16 and 17 are enlarged front and side views of a conventional seal assembly.
Figure 17:
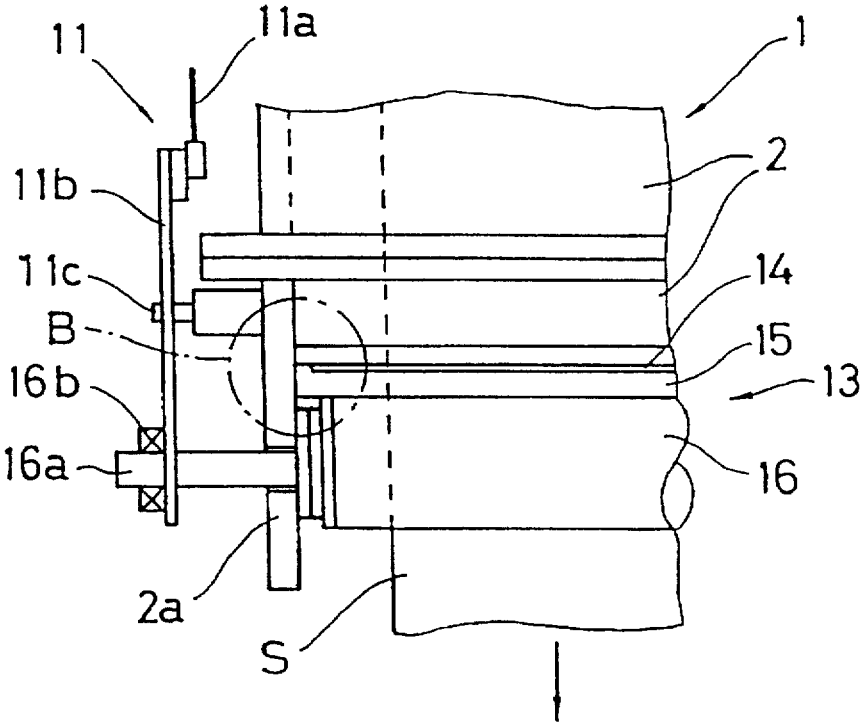
Fig. 17 Prior Art
Figure 18A:
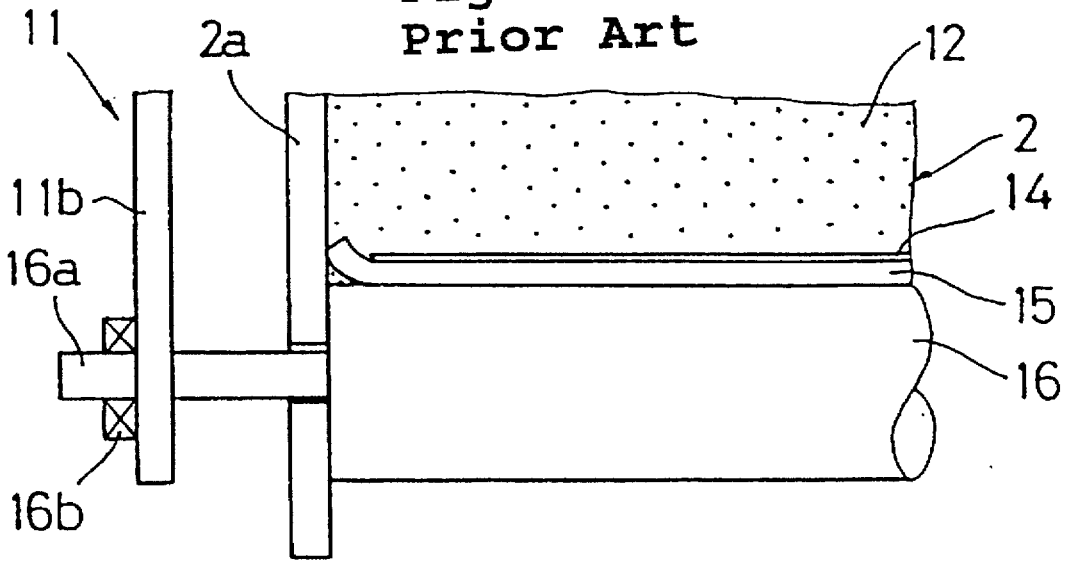
Fig. 18(a) Prior Art
FIGS. 18(*a*), 18(*b*) and 18(*c*) are explanatory side views of a conventional seal assembly.
Figure 18B:
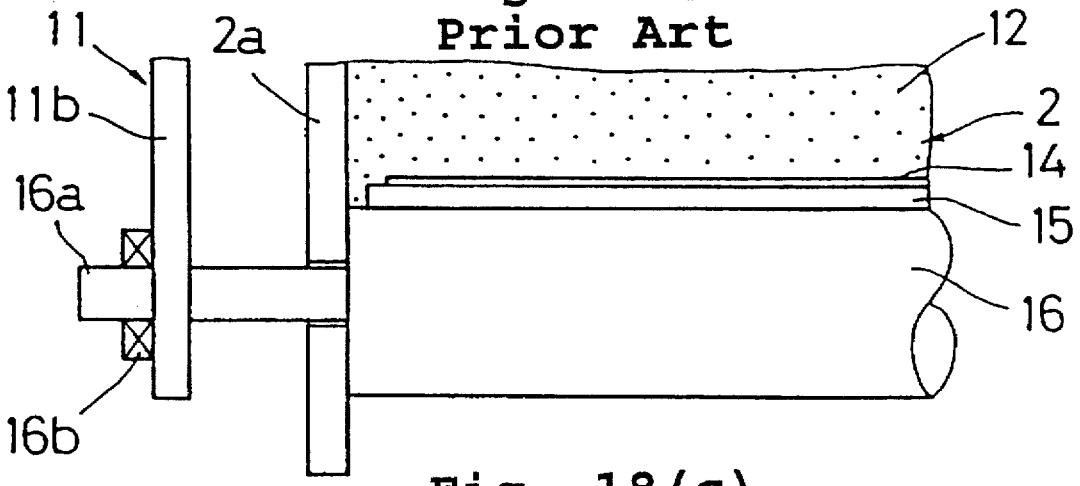
Fig. 18(b) Prior Art
Figure 18C:
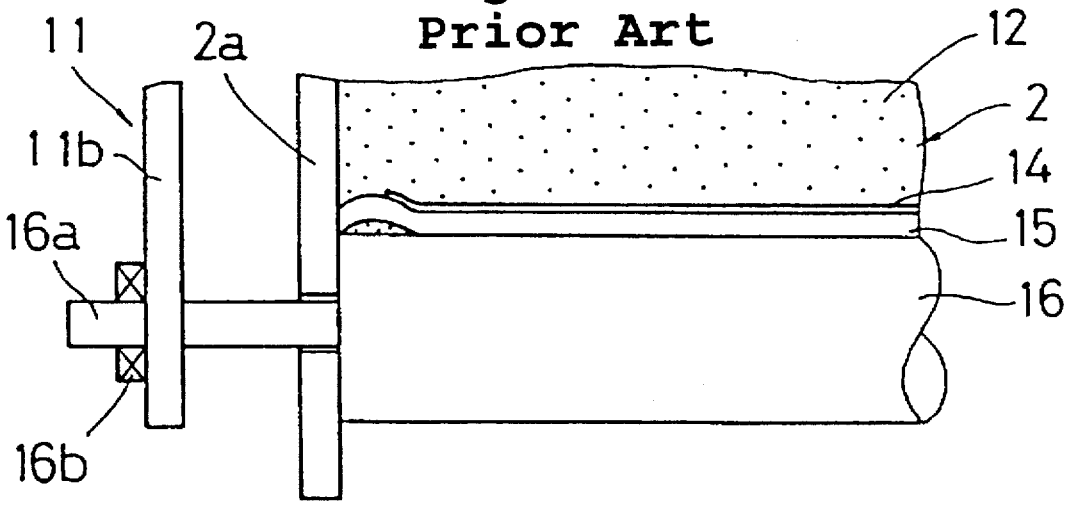
Fig. 18(c) Prior Art
Figure 19:
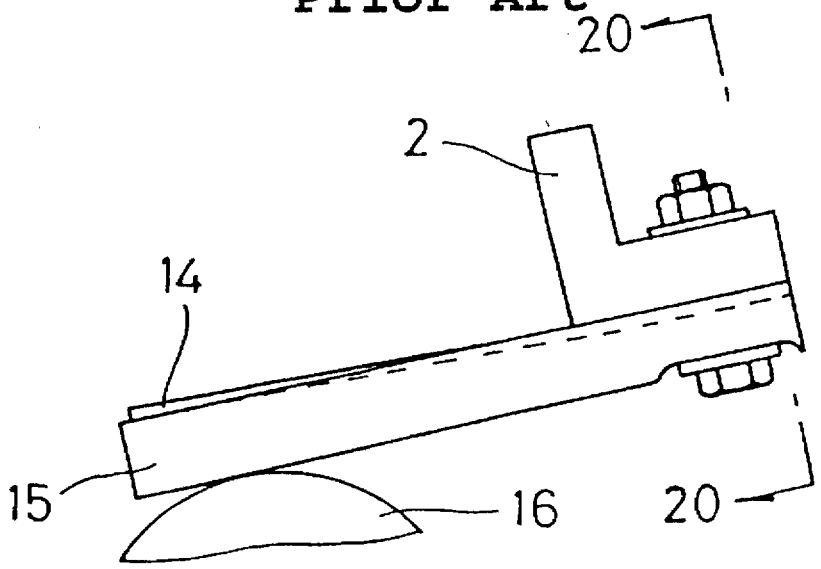
Fig. 19 Prior Art
FIG. 19 is an explanatory side view of a conventional seal assembly.
Figure 20:
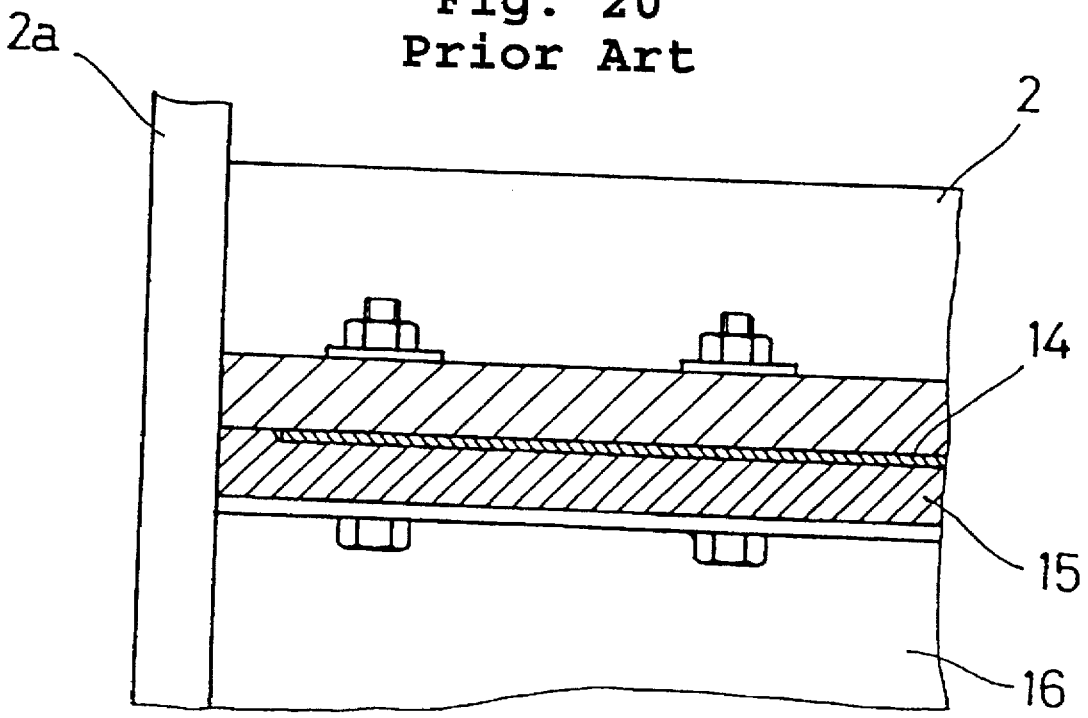
Fig. 20 Prior Art
FIG. 20 is a sectional view taken along a line 20—20 in FIG. 19.
Figure 21A:
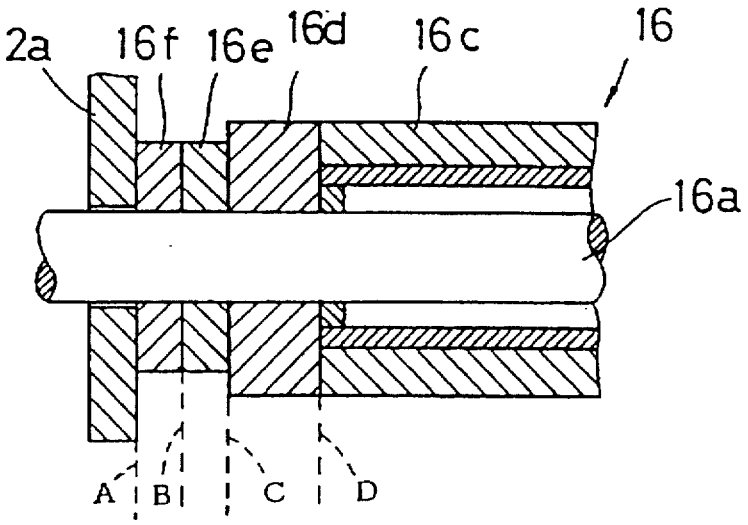
Fig. 21(a) Prior Art
FIGS. 21(*a*) and 21(*c*) are sectional views of sealing parts of a conventional seal assembly, and FIG. 21(*b*) is a graph showing coefficient of friction between the parts.
Figure 21B:
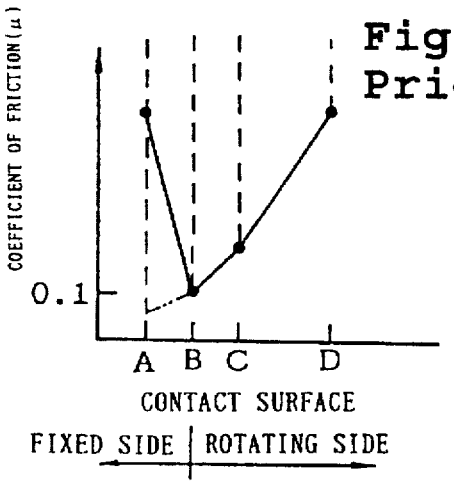
Fig. 21(b) Prior Art
Figure 21C:
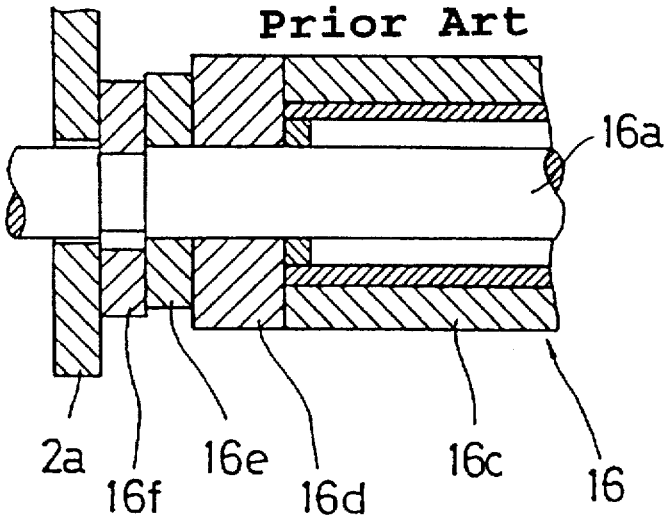
Fig. 21(c) Prior Art
Figure 22A:
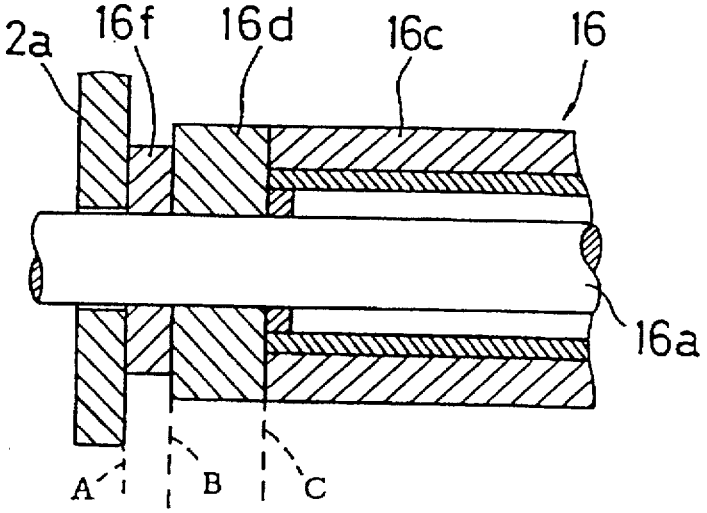
Fig. 22(a) Prior Art
FIGS. 22(*a*) and 22(*c*) are sectional views of sealing parts of a conventional seal assembly, and FIG. 22(*b*) is a graph showing coefficient of friction between the parts.
Figure 22B:
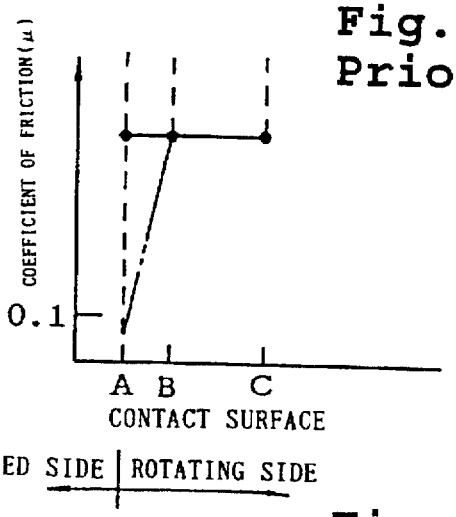
Fig. 22(b) Prior Art
Figure 22C:
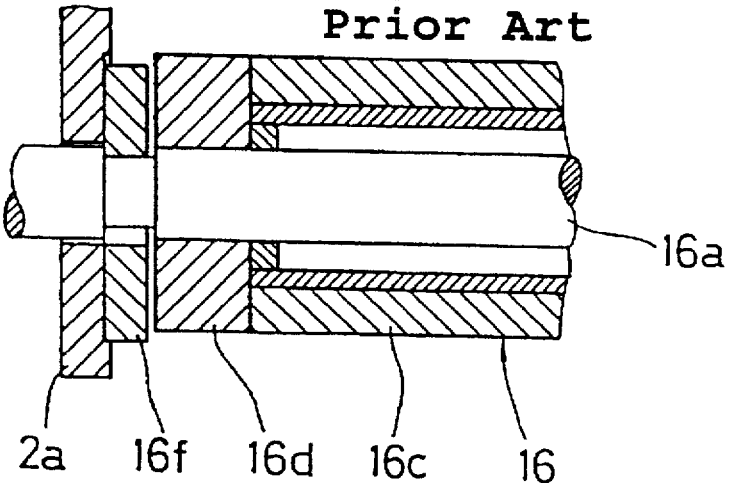
Fig. 22(c) Prior Art

The above-described slip disk 7 generates heat and softens due to its constant friction with the rotating of the elastic rotating roll 6. To increase its rigidity and wear resistance, various fillers may be added thereto. Most of polytetrafluoroethylene resins are likely to be greatly charged with electricity, possibly resulting in spark discharge. Most preferably, the polytetrafluoroethylene resin used should have an electric resistivity value of 1 to $10^7$ Ω·cm. Any resin having an electric resistivity value exceeding $10^7$ Ω·cm is not preferable because it is substantially equivalent to an insulating substance and so is greatly charged with static electricity. Any resin having an electric resistivity lower than 1Ω·cm, too, is not preferable due to its good conductivity. When the elastic pad 5 is cleaned or inspected, there is a fear of spark discharge resulting from static electricity charged in the body of the worker through the finger tips because of the rubbing of the work clothes or for other reasons. If one of the two slip disks 7, proximate to the roll body 6*c*, such as one shown at 7*f* in FIGS. 11(*a*) and 12(*a*), is formed of a metallic plate having a metallic surface, such as one in FIG. 13(*f*), frictional discharge can then be avoided with a low coefficient of friction. This slip disk is unlikely to be charged with electricity in itself, but should preferably be spaced away from the human body or other charged part for the same reasons as mentioned above. It is also desired that the elastic disk 8 has an electric resistivity of 1 to $10^7$ Ω·cm to prevent it from being charged with electricity for the same reasons as mentioned above. In particular, this is true in the elastic disk designed to rotate in unison with the elastic rotating roll 6, for instance, those located proximately to the roll body 6*c*, as shown in FIGS. 8(*a*), 10(*a*) and 12(*a*), because it is repeatedly engaged with or disengaged from the roll body 6*c*, and undergoes friction with the elastic pad 5 as well.

An elastic member 9 is inserted formed the through-hole 2*b* formed through the side plate 2*a* of the furnace wall 2 until it is engaged with a side edge of the elastic pad 5. This elastic member 9, with the end edge substantially conforming in shape to the side edge of the elastic pad 5, is preferably formed of a material having elastic properties such as silicone rubber, fluororubber, chloroprene rubber, nitrile-butadiene rubber, styrene-butadiene rubber, ethylene-propylene rubber, urethane rubber, hydrin rubber, butyl rubber, isoprene rubber, butadiene rubber, chlorinated polyethylene, acrylic rubber, polysulfide rubber, chlorosulfonated polyethylene, or an elastic material made of felt. The elastic member 9 is engaged at one end with the side edge of the elastic pad 5 on the side of the furnace body from side plate 2*a* of the furnace wall 2 and inserted at the other end through the through-hole 2*b* formed through the side plate 2*a* of the furnace wall 2, and is of length long enough to make a complete seal for the gap facing the side of the furnace between the side edge of the elastic pad 5 and the side plate 2*a* of the furnace wall 2 and to absorb the amount of elastic deformation.

As mentioned just above, the elastic member 9 is inserted through the through-hole 2*b* formed through the side plate 2*a* of the furnace wall 2. The plane of the through-hole 2*b* that faces the elastic rotating roll 6 is in alignment with an axial line extending from the line or plane along which the elastic rotating roll 6 and elastic pad 5 are engaged with each other when the metallic strip S is held between the elastic rotating rolls 6. When the elastic member 9 projects inside of the furnace, the end surface inside the furnace is pressedly engaged with the side edge of the elastic pad 5 and the elastic rotating roll 6 comes in contact with the outer surface of the elastic rotating roll 6.

Thus, the elastic member 9 is engaged with the side edge of the elastic pad 5 and yet properly abutted against the outer surface of the elastic rotating roll 6, so that both sides of the seal assembly 3 can be tightly closed up (or sealed up) with an improved sealability. Preferably, the elastic member 9 used for the purpose of improving sealability is formed of an impermeable rubber material or a sponge-like material of foamed fine cells, rather than of felt or other elastomer alone. The elastic pad 5, which is very troublesome to replace as earlier mentioned, must be of proper elasticity. The elastic member 9 cooperates with such an elastic pad 5, but it is adjustable from the outside of the furnace body 1 (the outside of the side plate 2*a* of the furnace wall 2) while the furnace is in operation. Since the elastic member 9 needs to be in close contact with the side edge of the elastic pad 5, it need not have a hardness more than that of elastic pad 5, in other words, it needs to be formed of such a soft spongy material as just mentioned. Preferably, the material to form the elastic member 9 has a hardness lying within the range of 10° to 50° as measured according to JIS S6050 (0.5° to 25° by ASTM D2240-A). Although felt has often been used to form the elastic pad 5, its softness and its nature to be deformed offer problems in terms of dimensional and other precision, when its side edge is cut, formed (fixed), and located. This is the reason why it is preferable that the elastic member 9 has a hardness or elasticity enough to follow the shape of the side edge of the elastic pad 5 in a relatively easy manner. When the elastic member 9 has a hardness lower than 10° as measured according to JIS S6050 (0.5° by ASTM D2240-A), its amount of deformation becomes too large due to the rigidity of the elastic pad 5. At a hardness more than 50°(25° by ASTM D2240-A), on the other hand, the elastic pad 5 becomes too large in the amount of deformation. In either case, sealability worsens.

In some cases, the elastic member 9 is engaged with the side edge of the elastic pad 5 projecting from the inner face of the side plate 2*a* of the furnace wall 2 and so is in contact with the outer surface of the elastic rotating roll 6, resulting in being readily charged with elctricity by the friction with the elastic rotating roll 6. It is thus preferable that the elastic member 9 has an electric resistivity value of $10^7$ Ω·cm or lower. Practically, the lower limit of this electric resistivity value may be 1 Ω·cm. The materials as mentioned above or a material made of felt, if its electric resistivity value exceeds $10^7$ Ω·cm, is substantially tantamount to an insulating material, and hence is greatly charged with electricity. When the elastic pad 5 is cleaned or inspected, static electricity charged in the body of the grounded worker is likely to cause spark discharge through the finger tips or a tool toward the elastic material 9.

Such an elastic member 9 may be formed of the material as mentioned above and felt, or silicone rubber, fluororubber, chloroprene rubber, nitrile-butadiene rubber, styrene-butadiene rubber, ethylene-propylene rubber, urethane rubber, hydrin rubber, butyl rubber, isoprene rubber, butadiene rubber, chlorinated polyethylene, acrylic rubber, polysulfide rubber, chlorosulfonated polyethylene. However, it is preferable that powders of carbon, metal or metal oxide are added to any one of the above materials for conductivity control, thereby imparting thereto the desired or a predetermined electric resistivity value. It is also preferable that a high-molecular polymer, high-molecular copolymer or high-molecular condensate with the target or a predetermined hardness imparted thereto is used as the spongy material of foamed fine cells.

For the elastic member 9, use may be made of a plurality of materials selected from polymer, copolymer, condensate consisting of silicone rubber, fluororubber, chloroprene rubber, nitrile-butadiene rubber, styrene-butadiene rubber, ethylene-propylene rubber, urethane rubber, hydrin rubber, butyl rubber, isoprene rubber, butadiene rubber, chlorinated polyethylene, acrylic rubber, polysulfide rubber, chlorosulfonated polyethylene which are combined together using a suitable binder, etc., to form a polymer composed by suitable binders which is then allowed to have the desired, or predetermined range of electric resistivity value by the addition of carbon or other powders thereto and foamed into a spongy material of fine cells, so that the desired or predetermined range of, hardness can be imparted thereto.

Reference numeral 10 is an elastic member moving mechanism that enables such an elastic member 9 to be detachably moved inwardly of the furnace body 1 from the outside of the furnace body 1. More specifically, this mechanism is designed to move the elastic member 9 toward or away from the side edge of the elastic pad 5 inserted through the through-hole **2*b* formed through the side plate 2*a* of the furnace wall 2**.

Figure 4:
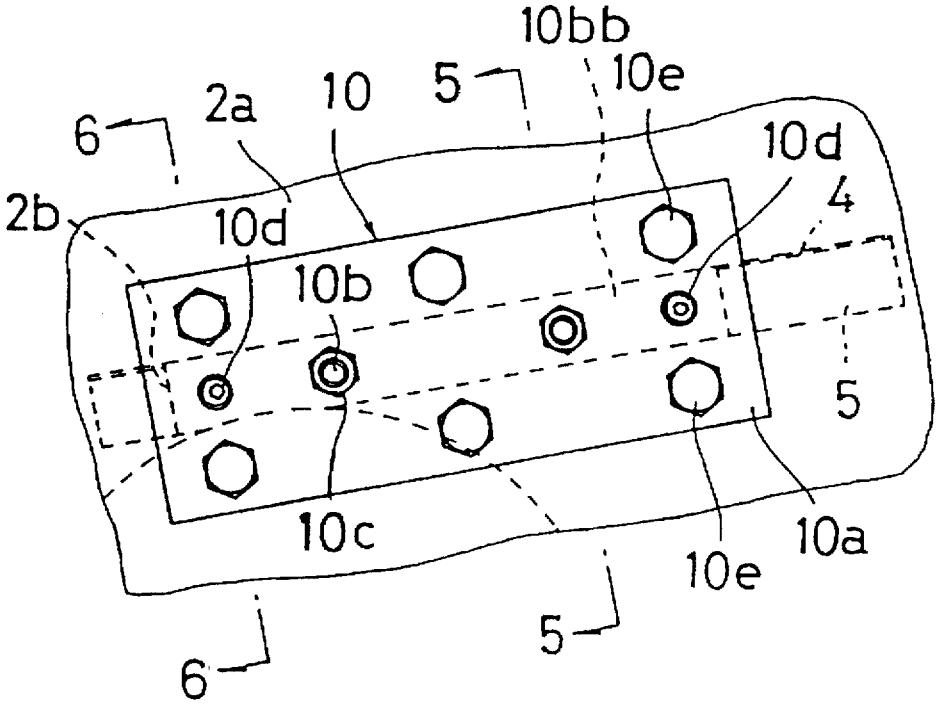
FIG. 4 is a side view explaining of the elastic member-moving mechanism.
Figure 5:
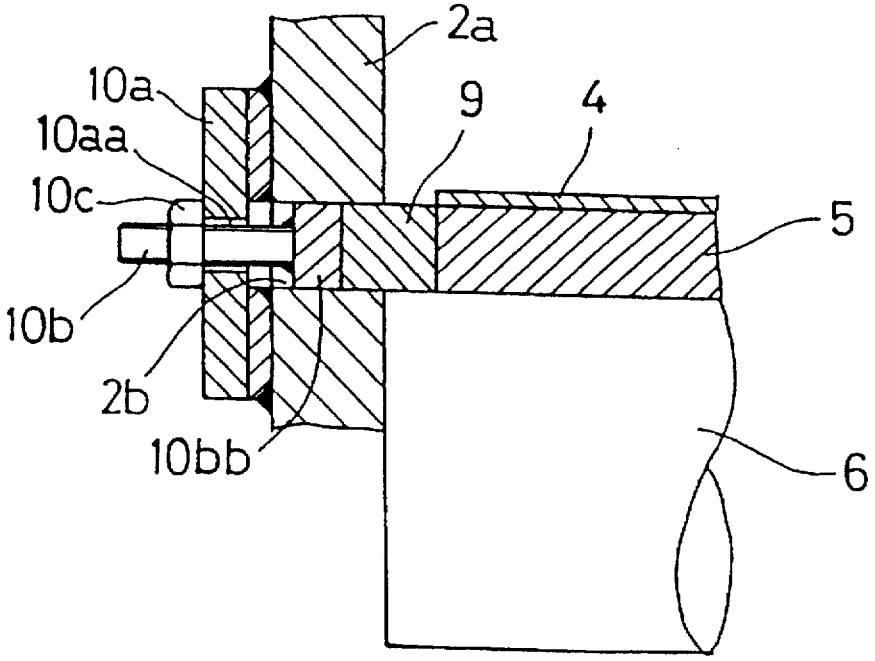
FIG. 5 is a sectional view taken along a line 5—5 in FIG. 4.
Figure 6:
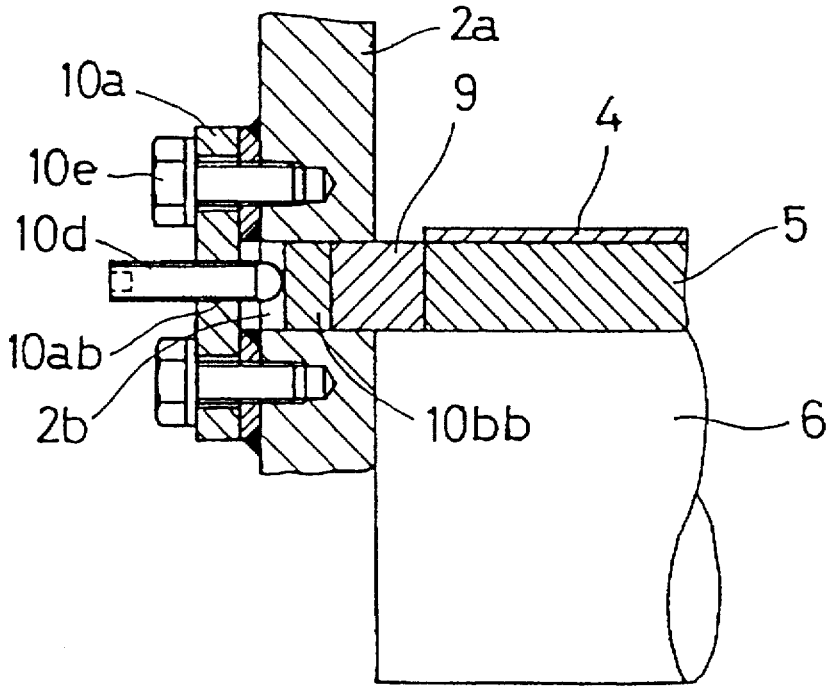
FIG. 6 is a sectional view taken along a line 6—6 in FIG. 4.

As can be specifically illustrated by FIGS. 4 to 6, the elastic member moving mechanism 10 includes: a closure member **10*a* provided for closing up the through-hole 2*b* formed through the side plate 2*a* of the furnace wall 2; a through-hole 10*aa* and a threaded through-hole 10*ab*; a fixing bolt 10*e* for fixing the closure member 10*a* at a given position of the side plate 2*a*; an external thread 10*b* inserted through the through-hole 10*aa* in the closure member 10*a* and attached to a head 10*bb* on which the elastic member 9 is put; a nut 10*c* threadedly fitted over the external thread 10*b*; and a bolt 10*d* threadedly inserted through the threaded through-hole 10*ab* in the closure member 10*a* and designed to apply pressure to the head 10*bb* and elastic member 9. The closure member 10*a* is fixed at a given position of the side plate 2*a* of the furnace wall 2 by means of the bolt 10*e*. By turning the nut 10*c* through the through-hole 10*aa* left-handedly when it is a right hand thread and turning the bolt 10*d* right-handedly when it is a right hand thread, the elastic member 9 is then moved inwardly of the furnace body 1, so that while the elastic member 9 is elastically deformed to a certain degree, the side edge of the elastic pad 5 can be in close contact with the outer surface of the elastic rotating roll 6 to close up the through-hole 2*b* in the side plate 2*a*. Conversely, the elastic member 9 is moved outwardly of the furnace body 1 by turning the bolt 10*d* threadedly inserted through the threaded through-hole 10*ab* left-handedly when it is a right hand thread and turning the nut 10*c* right-handedly when it is a right hand thread, so that while the elastic member 9 is elastically deformed to a certain degree through the head 10*bb***, and it can be in optimum state of contact for sealing up.

The replacement of this elastic member 9 can be achieved within a short time, if the bolt **10*e* by which the closure member 10*a* is fixed to the side plate 2*a* is removed from the outside of the furnace body 1** and is then threaded in place.

Reference numeral 11 generally shows a roll-driving mechanism designed to engage the elastic rotating roll 6 with the metallic strip S and elastic pad 5, which is not herein explained because it is the same as a roll-driving mechanism used with the above-described conventional seal assembly.

INDUSTRIAL APPLICABILITY

As hitherto mentioned, the present invention provides a seal assembly 3 located at an entrance and/or exit of a heat treatment furnace for heat treating a continuously fed metallic strip (S) using an atmospheric gas containing hydrogen gas and including an elastic rotating roll 6 which is engaged with an elastic pad 5 fixed on the surface of a seal plate 4 and the metallic strip (S) to seal the inside of the furnace against the outside air, wherein: elastic members 9 are provided in through-holes **2*b* formed through a side plate 2*a* of a furnace wall 2 at positions corresponding to both side edges of the elastic pad 5; and elastic member-moving mechanisms 10 are provided for engaging the elastic members 9 with the sides of the elastic pad 5. With the elastic member 9 properly engaged with the side edges of the elastic pad 5 by operating the elastic member-moving mechanisms 10 from the outside of the furnace, gap between the elastic pad 5 and the side plate 2*a* of the furnace wall 2 can be prevented by the elastic member 9**. Thus, the following benefits can be obtained.

(1) Proper sealing is reliably, easily and rapidly achievable without skill yet without failure. The time taken to replace the elastic pad 5 can be largely reduced.

(2) Much improved sealing properties are obtained.

(3) While the furnace is in operation, the side ends of the elastic pad 5 change, making the sealing properties of the seal assembly worse. However, such change can be regulated from the outside of the furnace.

(4) As a result, the amount of the furnace gas 12 leaking out of the seal assemblies 3 located at the entrance and exit of the heat treatment furnace decreases; so the risk of explosion or fire due to the leaking furnace gas 12 can be reduced to a minimum.

(5) The elastic members 9 engaged with the side edges of the elastic pad 5 have an electric resistivity value of 1 Ω·cm or more to $10^7$ Ω·cm or less. Static electricity chiefly caused by the rotational friction of the elastic rotating roll 6 with the elastic member 9 or static electricity caused by the deformation and release of the rotating elastic roll 6 is removed from the elastic member 9 through the furnace wall 2 that is grounded. Thus, the risk of explosion or fire due the ignition by electrostatic sparks of the furnace gas 12 leaking out of the seal assemblies 3 located at the entrance and/exit can be decreased to a minimum. Besides, when the elastic pad 5 is cleaned or inspected, spark discharge is unlikely to occur from the finger tips of the worker or tools charged with electricity. Thus, the risk of explosion or fire due to the ignition of the furnace gas 10 leaking from the seal assemblies 3 can be decreased to a minimum.

Figure 2:
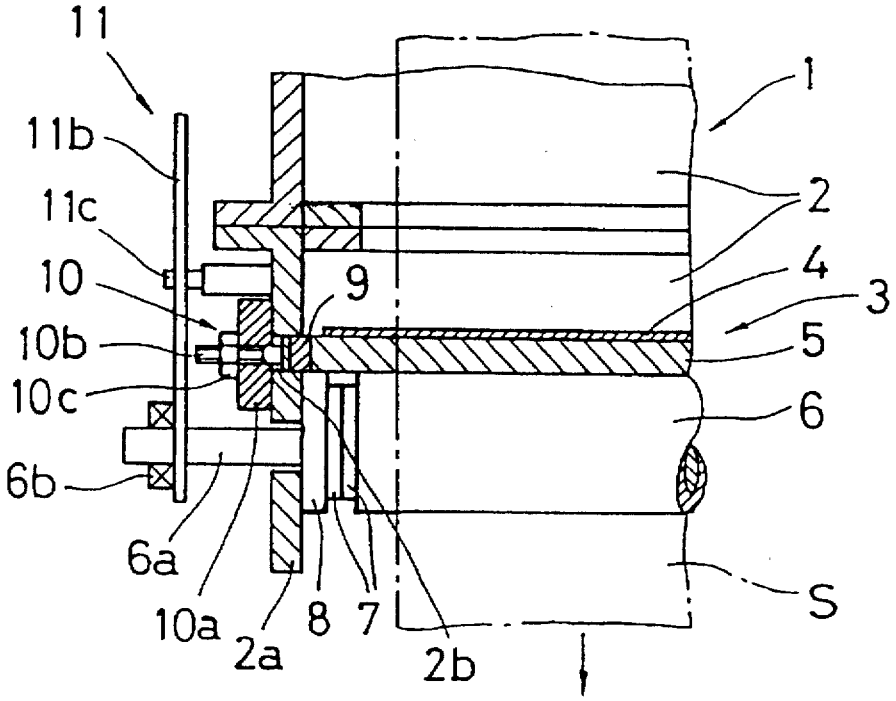
FIG. 2 is a sectional view taken along the a line 2—2 in FIG. 1.
Figure 3:
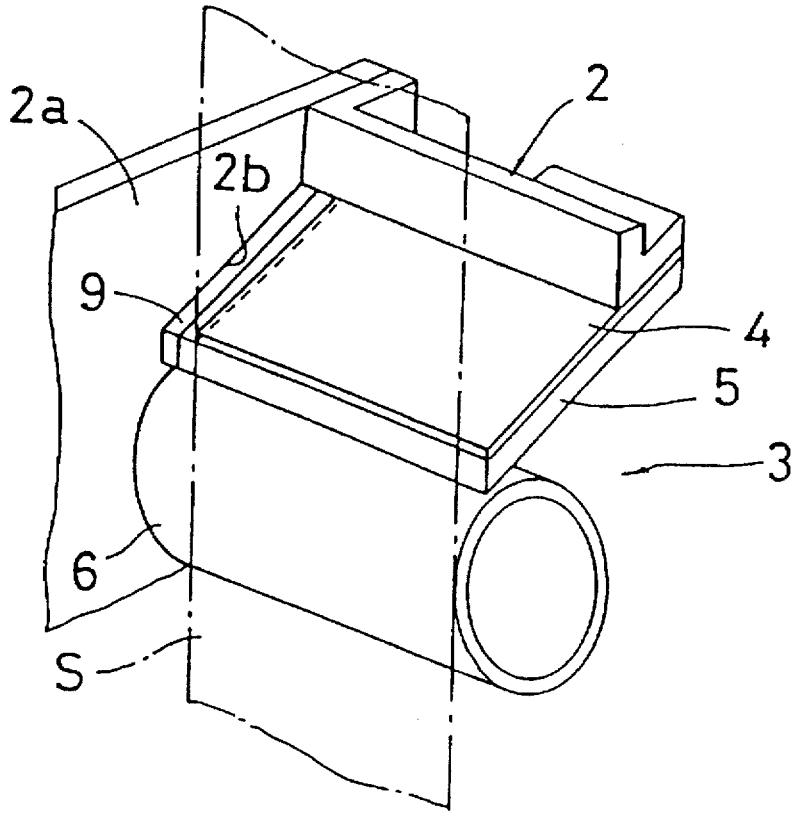
FIG. 3 is a perspective view of a general state, as viewed from within the furnace, of a part of the vicinity of the side plate of the present invention in the assembly shown in FIG. 1.

At least one of the elastic disks 8 which is engaged with the side plate **2*a* of the furnace wall 2, is fitted over a roll shaft 6*a* between the side plate 2*a* of the furnace wall 2 on which the elastic rotating roll 6 is rotatably mounted and a roll body 6*c* of the elastic rotating roll 6, the slip disk and said elastic disk being in surface contact with each other. In the contact surfaces of the parts from the roll body 6*c* to the side plate 2*a* of the furnace wall 2, the contact surface of the slip disks 7 and 7 has the lowest coefficient of dynamic friction, so that the roll body 6*c* of the elastic rotating roll 6 engaged with the metallic strip S can be rotated in alignment with the movement of the metallic strip S. Between the roll body 6*c* of the elastic rotating roll 6 and the side plate 2*a* of the furnace wall 2, at least two closely arranged slip disks 7, 7 positioned on the side of the roll body 6*c* slip with each other on the plane C in FIG. 7**(*a*). Thus, no slippage occurs on the contact surface between the roll body **6*c* and the slip disk 7 or elastic disk 8 attached adjacent thereto, [the plane D in FIG. 7**(*a*); other embodiments of the planes D and E in FIGS. 8(*a*), 10(*a*) and 12(*a*); the plane E in FIG. 9(*a*); and the plane D in FIG. 11(*a*)] and on the contact surface between the side plate **2*a* of the furnace wall 2 and the disk [the elastic disk 8 of the embodiment in FIG. 2] located adjacent thereto [the planes A and B in FIG. 7**(*a*) and the planes A and B in FIG. 8(*a*), 9(*a*), 10(*a*), 11(*a*) and 12(*a*) showing other embodiments].

As previously mentioned, at least two closely arranged slip disks 7 and elastic disks 8 are located in the described order on the side of the roll body **6*c* while they are brought in contact with each other, and in the contact surfaces of these disks, the contact surface of the slip disks 7 and 7 has the lowest coefficient of dynamic friction. Thus, when the roll body 6c is rotated in alignment with the movement of the metallic strip S, the rotation of the roll body 6c is transmitted to the slip disks 7. Then, the slip disks 7 and 7 slip with each other on the contact surface, so that the transmission of the rotation of the roll body 6c to the elastic disk 8 located on the side of the side plate 2a of the furnace wall 2 can be avoided. Consequently, no slippage occurs on the contact surfaces except between the slip disks 7 and 7; so the wearing-away of the ends of the roll body 6c of the elastic rotating roll 6, the elastic disk 8 and the side plate 2a of the furnace wall 2 can be avoided. The slip disks 7, because of consisting only of fluorocarbon resin or composed mainly of fluorocarbon resin which the slip disk is made of, the slip disk has a low coefficient of friction and so is very low in resistance to rotation. Moreover, since they are less wearable by slippage, they produces no or little swarf, so that the surface of the metallic strip S, which is required to be kept clean, cannot be stained. To add to this, they undergoes no change in the coefficient of friction due to wearing; so they can work under constantly invariable conditions. This ensures that no disturbance is caused to fine tension control of the red-hot metallic strip S fed through the furnace, and that the power needed for the rotation of the elastic rotating roll 6 can be saved; that is, energy savings are achievable. In the present invention, it is preferable that slip disks 7a and 7b located on the fixed side, all but the slip disk 7 that rotates following the elastic rotating roll 6 or is located proximately to the side of the roll body 6c, are entirely formed of an unfilled or filled fluorocarbon resin, including the inner surfaces of holes through which the roll shaft 6a is passed, as shown in FIGS. 13**(*a*) and (*b*). Such slip disks 7a and 7b, albeit coming into sliding friction with the roll shaft 6a, is decreased in terms of the wearing of the inner surfaces of the holes and resistance to rotation as well, because its coefficient of friction is low. Thus, the sealing properties of such sliding friction parts are much more improved.

Referring to the ability of the seal assembly to seal up the atmospheric gas containing hydrogen gas, the elastic disk 8 can be located in place while sufficient compression force is applied thereto to seal the disks against the atmospheric gas. Even in this case, it is unlikely that the rotation of the roll body 6c of the elastic rotating roll 6 may be transmitted to the side plate 2a of the furnace wall 2. Since slippage mainly occurs on the contact surface between the slip disks 7 and 7 that are less wearable and have a low coefficient of dynamic friction, it is possible to inhibit a decrease in the sealing properties of the ends of the elastic roll body 6. Thus, the seal assembly can be used in good sealing condition over an extended period of time with no need of making repairs not only on the elastic disk 8 and slip disks 7 located between the roll body 6c of the elastic rotation roll 6 and the side plate 2a of the furnace wall 2 but also on the elastic rotating roll 6 and the side plate 2a of the furnace wall 2.

In the present invention, the slip disk 7 undergoing continuous friction is predominantly made of a fluorocarbon resin containing a filler selected from the group consisting of glass fiber, graphite, glass fiber plus molybdenum disulfide, glass fiber plus graphite, bronze, and carbon fiber, or is formed of a metallic plate 7x coated thereon with such a fluorocarbon resin, and the elastic disk 8 is made of silicone rubber, fluororubber, chloroprene rubber, nitrile-butadiene rubber, styrene-butadiene rubber, ethylene-propylene rubber, urethane rubber, hydrin rubber, butyl rubber, isoprene rubber, butadiene rubber, chlorinated polyethylene, acrylic rubber, polysulfide rubber, chlorosulfonated polyethylene. As the disks 7 and 8 those having an electric resistivity value of 1 to $10^7$ Ω·cm are used. Since static electricity primarily caused by the friction of the parts is removed therefrom through the furnace body 1 that is grounded, the risk of explosion or fire due to the ignition by electrostatic sparks of the furnace gas 12 leaking out of the seal assemblies 3 located at the entrance and exit can be reduced to the minimum. To add to this, when the parts such as the elastic pad 5 fixed on the surface of the seal plate 4, and the roll body 6c of the elastic rotating roll 6 are cleaned or inspected, the risk of explosion or fire due to the ignition of the furnace gas leaking out of the seal assembly 3 which is caused by spark discharge of static electricity caused by friction of the clothes and charged in the body of the worker through the finger tips can be decreased to the minimum. Thus, the safety of the seal assembly can be much more improved.

Figure 10A:
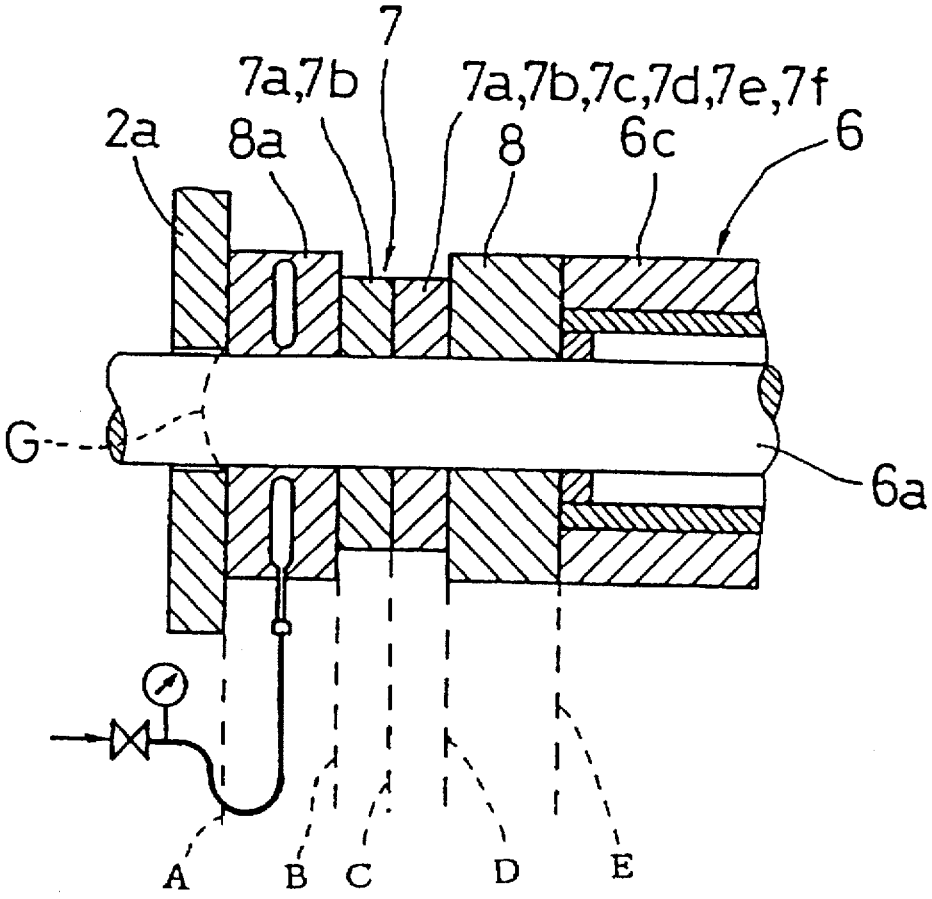
Figure 10B:
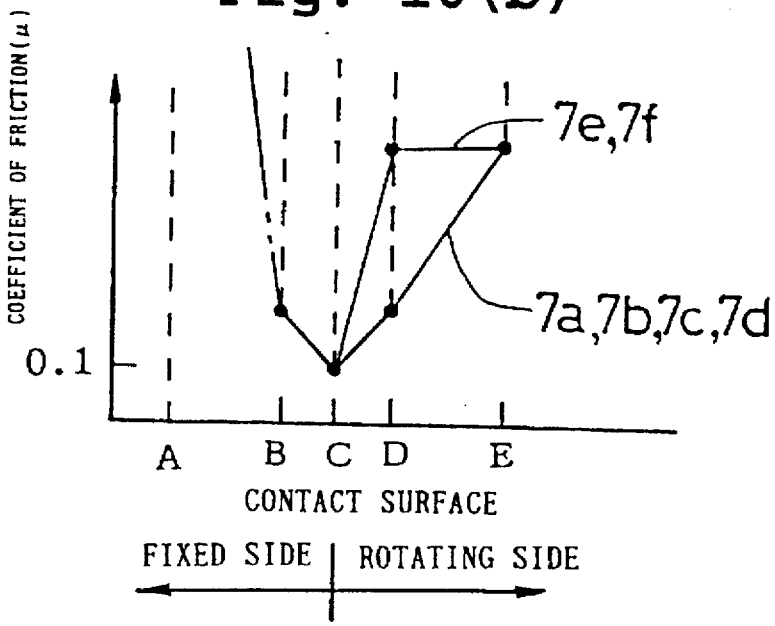

Preferably, a disk having the ability to be axially expanded with the fluid injected as shown at 8a in FIG. 10(*a*) is used as the elastic disk 8 to be engaged with the side plate 2a of the furnace wall 2. Even when it is worn away by a slippage on the contact surface, its width can be increased by a few milimeter by ten by regulating the pressure of the fluid injected, as desired, whereby a drop of the sealing properties at the ends of the elastic rotating roll 6 can be prevented.

The present seal assemblies for the entrance and exit of heat treatment furnaces using an atmospheric gas containing hydrogen gas have a number of benefits and so are of great industrial value.

What is claimed is:

1. A seal assembly located at an entrance or exit of a heat treatment furnace for heat treating a continuously fed metallic strip using an atmospheric gas containing hydrogen gas as a furnace gas and including an elastic rotating roll which is engaged with an elastic pad fixed on a surface of a seal plate and the metallic strip to seal an inside of the furnace against outside air, wherein elastic members are provided in through-holes formed through a side plate of a furnace wall at positions corresponding to both side edges of the elastic pad and elastic member-moving mechanisms are provided for engaging the elastic members with the sides of the elastic pad.

2. The seal assembly for heat treatment furnace using an atmospheric gas containing hydrogen gas as recited in claim 1, wherein the elastic members are each formed of any one of silicone rubber, fluororubber, chloroprene rubber, nitrile-butadiene rubber, styrene-butadiene rubber, ethylene-propylene rubber, urethane rubber, hydrin rubber, butyl rubber, isoprene rubber, butadiene rubber, chlorinated polyethylene, acrylic rubber, polysulfide rubber, chlorosulfonated polyethylene, and felt.

3. The seal assembly for heat treatment furnace using an atmospheric gas containing hydrogen gas as recited in claim 1 wherein the elastic members are each formed of any one of high-molecular addition polymer, high-molecular copolymer or high-molecular polycondensate selected from a group consisting of silicone rubber, fluororubber, chloroprene rubber, nitrile-butadiene rubber, styrene-butadiene rubber, ethylene-propylene rubber, urethane rubber, hydrin rubber, butyl rubber, isoprene rubber, butadiene rubber, chlorinated polyethylene, acrylic rubber, polysulfide rubber, and chlorosulfonated polyethylene, said polymer containing carbon or metal powders to impart thereto a given range of electric resistivity value and being foamed into a fine cell form of spongy material having a given range of hardness.

4. The seal assembly for heat treatment furnace using an atmospheric gas containing hydrogen gas as recited in claim 1 wherein the elastic members are each formed of a composite material comprising two or more of high-molecular addition polymer, high-molecular copolymer or high-molecular polycondensate selected from a group consisting of silicone rubber, fluororubber, chloroprene rubber, nitrile-butadiene rubber, styrene-butadiene rubber, ethylene-propylene rubber, urethane rubber, hydrin rubber, butyl rubber, isoprene rubber, butadiene rubber, chlorinated polyethylene, acrylic rubber, polysulfide rubber, and chlorosulfonated polyethylene, said composite material containing carbon or metal powders to impart thereto a given range of electric resistivity value and being foamed into a fine cell form of spongy material having a given range of hardness.

5. The seal assembly for heat treatment furnace using an atmospheric gas containing hydrogen gas as recited in claim 1 wherein the elastic members have an electric resistivity value of 1 to $10^7$ Ω·cm.

6. The seal assembly for heat treatment furnace using an atmospheric gas containing hydrogen gas as recited in claim 1 wherein the elastic members have a hardness of 0.5° to 25° as measured according to ASTM D2240-A.

7. The seal assembly for heat treatment furnace using an atmospheric gas containing hydrogen gas as recited in claim 1 wherein at least two closely-set slip disks arranged in an axial direction of a side of a roll body and, at least one of elastic disks which is engaged with the side plate of the furnace wall are fitted over a roll shaft between the side plate of the furnace wall on which the elastic rotating roll is rotatably mounted and the roll body of the elastic rotating roll the slip disk and said elastic disk being in surface contact with each other, and in contact surfaces of parts present from the roll body to the side plate of the furnace wall the contact surfaces of the slip disks have the lowest coefficient of dynamic friction.

8. The seal assembly for heat treatment furnace using an atmospheric gas containing hydrogen gas as recited in claim 7, wherein the slip disk is made of a sheet form of fluorocarbon resin or a sheet form containing as a main component fluorocarbon resin added by a filler containing any one of glass fiber, graphite, glass fiber plus molybdenum disulfide, glass fiber plus grapfiber, bronze, and carbon fiber, or a sheet form of metal in which said fluorocarbon resin or said fluorocarbon resin with the filler is coated, sprayed, baked, or the materials in a form of sheet being pasted to one side or both sides thereof, or the entire surface thereof including inner and outer and side surfaces.

9. The seal assembly for heat treatment furnace using an atmospheric gas containing hydrogen gas as recited in claim 8, wherein a resinous portion of the surface of the slip disk has an electric resistivity value of 1 to $10^7$ Ω·cm.

10. The seal assembly for heat treatment furnace using an atmospheric gas containing hydrogen gas as recited claim 7 wherein in the at least two closely-set slip disks arranged in the axially direction of the side of the roll body one slip disk that is located proximately to the roll body is a slip disk made of a metallic plate having a metallic surface, or a slip disk in which materials containing only fluorocarbon resin or containing fluorocarbon resin as a main component added by a filler containing any one of glass fiber, graphite, glass fiber plus molybdenum disulfide, glass fiber plus graphite, bronze, and carbon fiber are coated, sprayed, baked, or the material in a form of a sheet being pasted to one side or both sides of a metallic sheet or the entire surface thereof including inner, outer and side surfaces thereof.

11. The seal assembly for heat treatment furnace using an atmospheric gas containing hydrogen gas as recited claim 7, wherein the elastic disk is made of silicone rubber, fluororubber, chloroprene rubber, nitrile-butadiene rubber, styrene-butadiene rubber, ethylene-propylene rubber, urethane rubber, hydrin rubber, butyl rubber, isoprene rubber, butadiene rubber, chlorinated polyethylene, acrylic rubber, polysulfide rubber, or chlorosulfonated polyethylene.

12. The seal assembly for heat treatment furnace using an atmospheric gas containing hydrogen gas as recited claim 7 wherein the elastic disk engaged with the side plate of the furnace wall includes an expanding mechanism that is axially actuated by pressure of a fluid to be injected.

13. The seal assembly for heat treatment furnace using an atmospheric gas containing hydrogen gas as recited claims 7, wherein the elastic disk has an electric resistivity value of 1 to $10^7$ Ω·cm.

* * * * *